US009978328B2

(12) United States Patent
Cho et al.

(10) Patent No.: US 9,978,328 B2
(45) Date of Patent: May 22, 2018

(54) SCAN DRIVER WHICH REDUCES A VOLTAGE RIPPLE

(71) Applicant: Samsung Display Co., Ltd., Yongin-si, Gyeonggi-do (KR)

(72) Inventors: Sehyoung Cho, Yongin-si (KR); Kyunghoon Kim, Yongin-si (KR); Dongwoo Kim, Yongin-si (KR); Ilgon Kim, Yongin-si (KR); Kangmoon Jo, Yongin-si (KR); Hyunjoon Kim, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 53 days.

(21) Appl. No.: 15/019,741

(22) Filed: Feb. 9, 2016

(65) Prior Publication Data

US 2016/0247479 A1 Aug. 25, 2016

(30) Foreign Application Priority Data

Feb. 24, 2015 (KR) ..... 10-2015-0026069

(51) Int. Cl.
*G09G 3/36* (2006.01)

(52) U.S. Cl.
CPC ... *G09G 3/3677* (2013.01); *G09G 2310/0286* (2013.01)

(58) Field of Classification Search
CPC ..... G09G 2310/0286; G09G 3/3611; G09G 3/3677
USPC ..... 345/55, 98–11; 326/62, 63, 80; 327/333
See application file for complete search history.

(56) References Cited

U.S. PATENT DOCUMENTS

2007/0296662 A1* 12/2007 Lee ..... G09G 3/3677 345/87
2007/0297559 A1* 12/2007 Cho ..... G09G 3/3677 377/64
2012/0019497 A1* 1/2012 Kim ..... G09G 3/3677 345/210
2012/0269316 A1* 10/2012 Jang ..... G09G 3/3677 377/75

FOREIGN PATENT DOCUMENTS

KR 2005-0117303 12/2005
KR 2007-0119346 12/2007
KR 2011-0123459 11/2011
KR 2014-0032792 3/2014

* cited by examiner

*Primary Examiner* — Ram Mistry
(74) *Attorney, Agent, or Firm* — Innovation Counsel, LLP

(57) ABSTRACT

There is provided a scan driver. The scan driver includes stages. An ith (i is a natural number) stage circuit includes an output unit, a controller configured to control the voltage of the second node in response to a kth (k is a natural number) clock signal supplied to a second input terminal, and an input unit configured to control the voltages of the first node and the second node in response to a carry signal of a previous stage that is supplied to a third input terminal and a carry signal of at least one next stage. The kth clock signal maintains a gate on voltage at a point of time at which a voltage of the jth clock signal is changed to a gate on voltage.

20 Claims, 16 Drawing Sheets

SCAN DRIVER WHICH REDUCES A VOLTAGE RIPPLE

CROSS-REFERENCE TO RELATED APPLICATION

This application claims priority to and the benefit of Korean Patent Application No. 10-2015-0026069, filed on Feb. 24, 2015, in the Korean Intellectual Property Office, the entire contents of which are incorporated herein by reference in their entirety.

BACKGROUND

1. Field

The present inventive concept relates to a scan driver.

2. Description of the Related Art

With the development of information technology (IT), importance of a display device that is an interface device between a user and information is spotlighted. Accordingly, use of the display device such as a liquid crystal display device (LCD), an organic light emitting display device (OLED), and a plasma display panel (PDP) is increasing.

SUMMARY

An embodiment of the present inventive concept relates to a scan driver capable of being applied to a large panel and securing stability of driving.

A scan driver according to an embodiment of the present inventive concept includes stages respectively connected to scan lines to output one of a plurality of clock signals as a scan signal. An ith (i is a natural number) stage circuit among the stages includes an output unit configured to supply an ith carry signal to a first output terminal and supply an ith scan signal to a second output terminal by using a jth (j is a natural number) clock signal supplied to a first input terminal in response to voltages of a first node and a second node, a controller configured to control the voltage of the second node in response to a kth (k is a natural number) clock signal supplied to a second input terminal, and an input unit configured to control the voltages of the first node and the second node in response to a carry signal of a previous stage that is supplied to a third input terminal and a carry signal of at least one subsequent stage. The kth clock signal maintains a gate on voltage when a voltage of the jth clock signal is rising from a gate off voltage to a gate on voltage.

The ith stage receives a first power source set to have a gate off voltage from a first power source input terminal and receives a second power source set to have a gate off voltage and having a different voltage from that of the first power source from a second power source input terminal.

The controller includes a first transistor having a first electrode and a gate electrode connected to the second input terminal, a second transistor connected between a second electrode of the first transistor and the first power source input terminal and having a gate electrode connected to the first output terminal, a third transistor connected between the second input terminal and the second node and having a gate electrode connected to the second electrode of the first transistor, and a fourth transistor connected between the second node and the first power source input terminal and having a gate electrode connected to the first output terminal.

The controller further includes a second first transistor having a first electrode and a gate electrode connected to a control input terminal, a second second transistor connected between a second electrode of the second first transistor and the first power source input terminal and having a gate electrode connected to the first output terminal, a second third transistor connected between the control input terminal and the second node and having a gate electrode connected to the second electrode of the second first transistor, and a second fourth transistor connected between the second node and the first power source input terminal and having a gate electrode connected to the first output terminal.

The control input terminal receives a clock signal having an inverted clock signal of the kth clock signal.

The controller includes a first transistor having a first electrode and a gate electrode connected to the second input terminal, a second transistor connected between a second electrode of the first transistor and the first power source input terminal and having a gate electrode connected to the first node, a third transistor connected between the second input terminal and the second node and having a gate electrode connected to the second electrode of the first transistor, and a fourth transistor connected between the second node and the first power source input terminal and having a gate electrode connected to the first node.

The output unit includes a fifth transistor connected between the first input terminal and the first output terminal and having a gate electrode connected to the first node, a sixth transistor connected between the first output terminal and the second power source input terminal and having a gate electrode connected to the second node, a seventh transistor connected between the first input terminal and the second output terminal and having a gate electrode connected to the first node, an eighth transistor connected between the second output terminal and the first power source input terminal and having a gate electrode connected to the second node, a first capacitor connected between the first node and the second output terminal, and a second capacitor connected between the first node and the first output terminal.

The output unit further includes a $16^{th}$ transistor connected between the second output terminal and the first power source input terminal and turned on when a carry signal of a subsequent stage is supplied.

The carry signal of the subsequent stage is an (i+4)th carry signal.

The input unit includes a ninth transistor connected between the first node and the second power source input terminal and turned on when a first carry signal of a subsequent stage is supplied, a tenth transistor having a first electrode and a gate electrode connected to the third input terminal and having a second electrode connected to the first node, a $11^{th}$ transistor connected between the first node and the second power source input terminal and having a gate electrode connected to the second node, a $12^{th}$ transistor connected between the second node and the second power source input terminal and having a gate electrode connected to the third input terminal, and a $13^{th}$ transistor connected between the second power source input terminal and the first output terminal and turned on when a second carry signal of a subsequent stage is supplied.

An (i−4)th carry signal is supplied to the third input terminal.

The first carry signal is an (i+6)th carry signal and the second carry signal is an (i+4)th carry signal.

The first carry signal and the second carry signal are (i+6)th carry signals.

The input unit further includes a $14^{th}$ transistor connected between the first node and the second power source input terminal and turned on when the second carry signal is input and a $15^{th}$ transistor having a first electrode and a gate electrode connected to the second electrode of the $14^{th}$ transistor and having a second electrode connected to the second power source input terminal.

The first carry signal is an (i+8)th carry signal and the second carry signal is an (i+6)th carry signal.

An (i+1)th stage shares a controller of the ith stage.

A second node of the (i+1)th stage is electrically connected to a second node of the ith stage.

A (j+1)th clock signal of which gate on voltage period overlaps the jth clock signal is supplied to the second node of the (i+1)th stage. The kth clock signal maintains a gate on voltage when voltages of the jth clock signal and the (j+1)th clock signal are rising from gate off voltages to gate on voltages.

The ith stage is formed on one side of a panel and supplies a scan signal to an ith scan line. The scan driver further comprises a control transistor connected to the other side of the ith scan line to supply the jth clock signal to the ith scan line when an (i+1)th carry signal is supplied.

The clock signals are sequentially supplied to maintain gate on voltages in 4 horizontal periods and to maintain gate off voltages in 4 horizontal periods. A previously supplied clock signal and a currently supply clock signal have a phase difference of a 1 horizontal period.

BRIEF DESCRIPTION OF THE DRAWINGS

Example embodiments will now be described more fully hereinafter with reference to the accompanying drawings; however, the inventive concept may be embodied in different forms and should not be construed as limited to the embodiments set forth herein. Rather, these embodiments are provided so that this disclosure will be thorough and complete, and will full convey the scope of the example embodiments to those skilled in the art.

In the drawings, dimensions may be exaggerated for clarity of illustration. It will be understood that when an element is referred to as being "between" two elements, it can be the only element between the two elements, or one or more intervening elements may also be present between the two elements. Like reference numerals refer to like elements throughout the specification.

DETAILED DESCRIPTION

Figure 1:
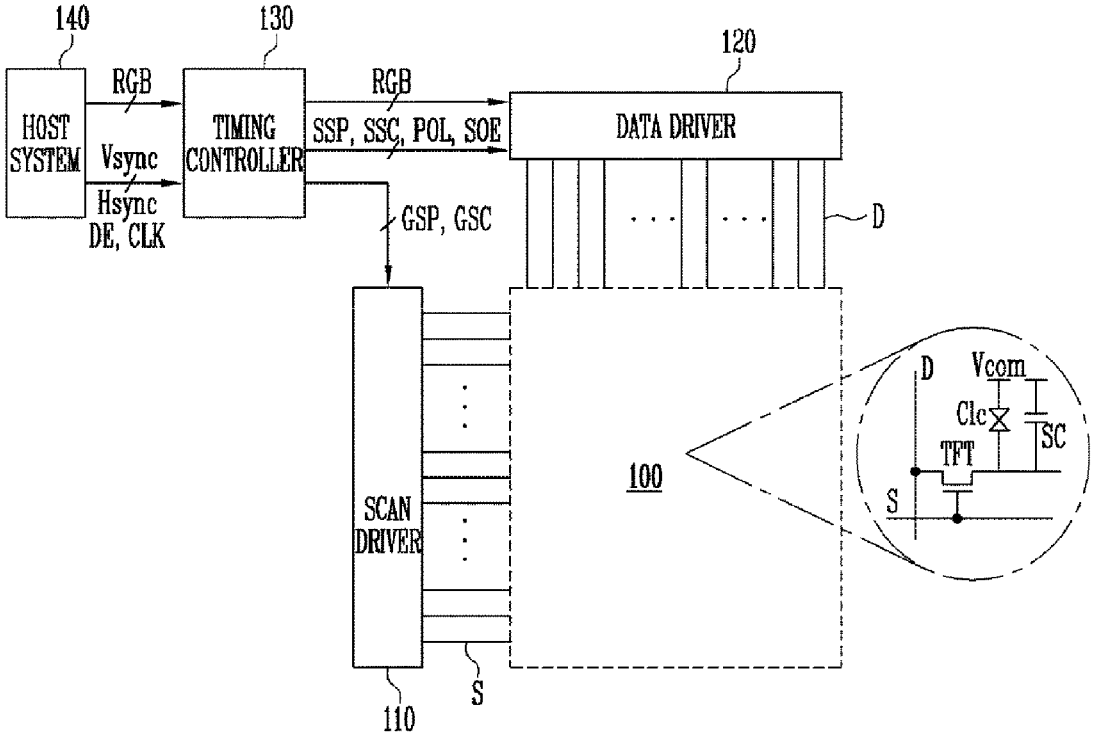
FIG. 1 is a block diagram schematically illustrating a display device according to an embodiment of the present inventive concept.

Hereinafter, the embodiments of the present inventive concept and other required matters will be described in detail with reference to the accompanying drawings such that a person skilled in the art easily understands contents of the present inventive concept. However, since the present inventive concept is implemented in various forms within the scope of the claims, the embodiment described hereinafter is merely illustrative regardless of expressions.

That is, the present inventive concept is not limited to the embodiments disclosed hereinafter but may be implemented in various forms, and it will be understood that when an element is referred to as being "connected to" another element, it can be directly connected to the other element or intervening elements may also be present between the element and the another element. In contrast, when an element is referred to as being "directly connected to" another element, no intervening elements are present. Also, in the drawings, like reference numerals refer to like elements although they are illustrated in different drawings.

FIG. 1 is a block diagram schematically illustrating a display device according to an embodiment of the present inventive concept. In FIG. 1, for convenience sake, a display device is illustrated as being a liquid crystal display device (LCD). However, the present inventive concept is not limited thereto.

Referring to FIG. 1, the display device according to the embodiment of the present inventive concept includes a pixel unit 100, a scan driver 110, a data driver 120, a timing controller 130, and a host system 140.

The pixel unit 100 means a valid display area of a liquid crystal panel. The liquid crystal panel includes a thin film transistor (hereinafter, referred to as TFT) substrate and a color filter substrate. A liquid crystal layer is disposed between the TFT substrate and the color filter substrate. Data lines D and scan lines S are formed on the TFT substrate and a plurality of pixels are arranged in a matrix configuration in regions defined by the scan lines S and the data lines D.

A TFT included in a pixel transmits a voltage of a data signal supplied via a data line D to a liquid crystal capacitor Clc in response to a scan signal from a scan line S. For this purpose, a gate electrode of the TFT is connected to the scan line S and a first electrode of the TFT is connected to the data line D. A second electrode of the TFT is connected to the liquid crystal capacitor Clc and a storage capacitor SC.

Here, the first electrode means one of a source electrode and a drain electrode of the TFT and the second electrode means the other electrode of the TFT which is different from the first electrode. For example, when the first electrode is the source electrode, the second electrode may be the drain electrode. In addition, the liquid crystal capacitor Clc may be a capacitor formed between a pixel electrode (not shown) and a common electrode that are formed on the TFT substrate. The storage capacitor SC maintains a voltage of a data signal transmitted to the pixel electrode during a predetermined time until a next data signal is supplied.

A black matrix and a color filter may be formed on the color filter substrate. Instead, the black matrix and the color filter may be formed on the TFT substrate.

The common electrode may be formed on the color filter substrate in a twisted nematic (TN) mode and a vertical alignment (VA) mode, and be formed on the TFT substrate with the pixel electrode in a horizontal electric field driving method such as an in plane switching (IPS) mode and a fringe field switching (FFS) mode. Here, a liquid crystal mode of a liquid crystal panel may be any liquid crystal mode which includes the above-described TN mode, VA mode, IPS mode, and FFS mode.

The data driver 120 converts image data RGB input from the timing controller 130 into positive polarity/negative polarity gamma compensating voltages and generates positive polarity/negative polarity analog data voltages. The positive polarity/negative polarity analog data voltages generated by the data driver 120 are supplied to the data lines D as data signals.

Figure 2:
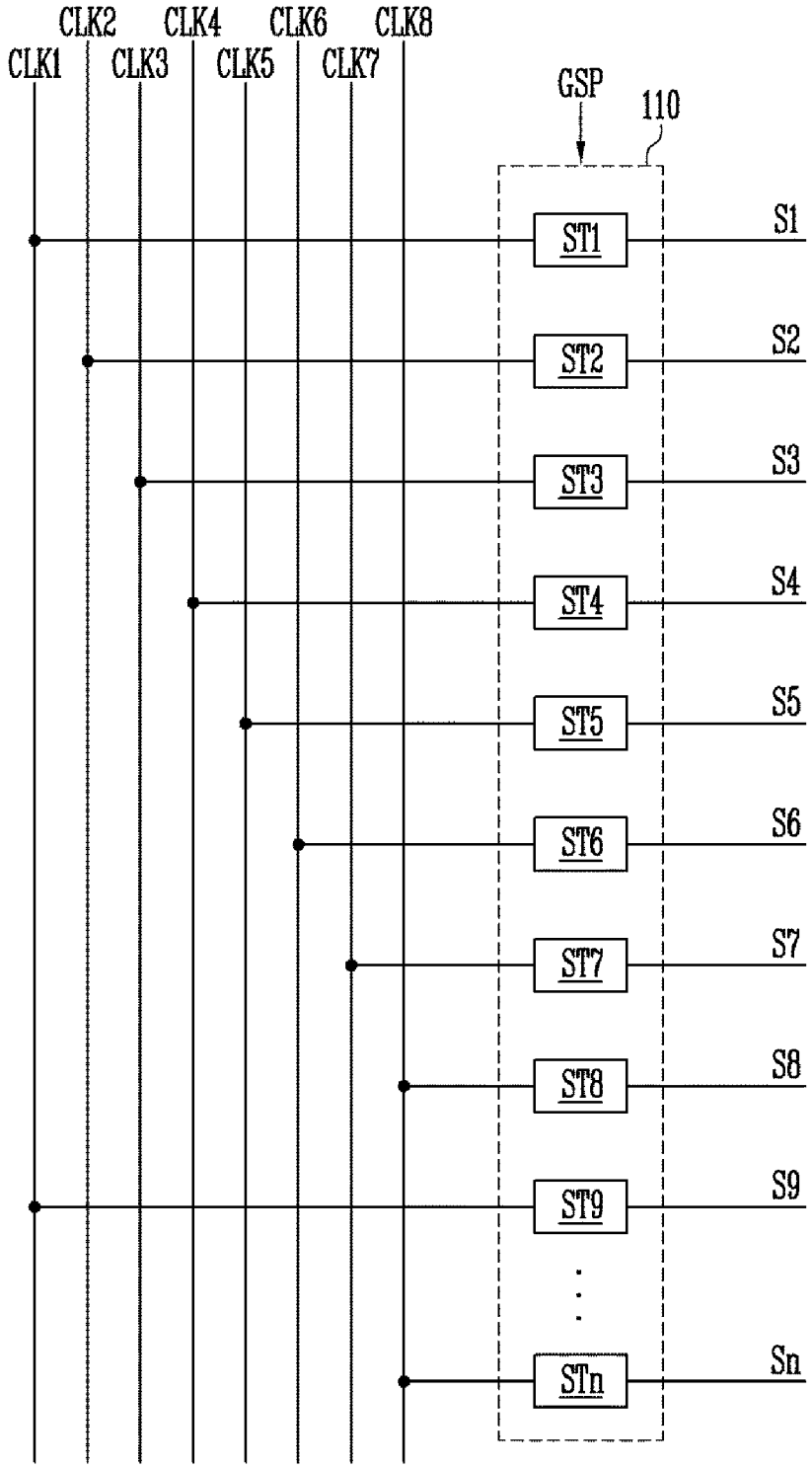
FIG. 2 is a view schematically illustrating the scan driver of FIG. 1.

The scan driver 110 supplies scan signals to the scan lines S. For example, the scan driver 110 may sequentially supply the scan signals to the scan lines S. When the scan signals are sequentially supplied to the scan lines S, the pixels are selected in units of horizontal lines and the pixels selected by the scan signals receive the data signals. For this purpose, the scan driver 110 includes stages ST respectively connected to the scan lines S as illustrated in FIG. 2. The scan driver 110 may be formed on the liquid crystal panel in the form of an amorphous silicon gate (ASG) driver. That is, the scan driver 110 may be formed on the TFT substrate through a thin film process which forms the TFT. In addition, the scan driver 110 may be formed on both sides of the liquid crystal panel with the pixel unit 100 interposed therebetween.

The timing controller 130 supplies gate control signals to the scan driver 110 according to timing signals such as the image data RGB, a vertical synchronizing signal Vsync, a horizontal synchronizing signal Hsync, a data enable signal DE, and a clock signal CLK that are output from the host system 140 and supplies data control signals to the data driver 120.

A gate start pulse GSP and one or more gate shift clocks GSC are included in the gate control signals. The gate start pulse GSP controls timing of a first scan signal. The gate shift clocks GSC mean one or more clock signals for shifting the gate start pulse GSP.

The data control signals include a source start pulse SSP, a source sampling clock SSC, a source output enable signal SOE, and a polarity control signal POL. The source start pulse SSP controls a data sampling starting point of the data driver 120. The source sampling clock SSC controls a sampling operation of the data driver 120 based on a rising or falling edge. The source output enable signal SOE controls output timing of the data driver 120. The polarity control signal POL inverts polarities of the data signals output from the data driver 120 every j horizontal period (j is a natural number). Here, when the image data RGB is transmitted by the mini low voltage differential signalling (LVDS) interface specification, the source start pulse SSP and the source sampling clock SSC may be omitted.

The host system 140 supplies the image data RGB to the timing controller 130. The image data RGB may have the LVDS specification and a transition minimized differential signalling (TMDS) specification. In addition, the host system 140 supplies the timing signals Vsync, Hsync, DE, and CLK to the timing controller 130.

FIG. 2 is a view schematically illustrating the scan driver of FIG. 1. In FIG. 2, for convenience sake, only clock signals supplied to the scan lines S are illustrated.

Referring to FIG. 2, the scan driver 110 according to the embodiment of the present inventive concept includes a plurality of stages ST1 to STn and each of the stages ST1 to STn is connected to one of the scan lines S1 to Sn. That is, the ith (i is a natural number) stage STi is connected to the ith scan line Si and supplies a scan signal to the ith scan line Si.

The stages ST1 to STn respectively receive one or more clock signals among the plurality of clock signals (CLK1 to CLK8) supplied from the timing controller 130 as the gate shift clocks GSC.

For example, the first stage ST1 receives the first clock signal CLK1, the second stage ST2 receives the second clock signal CLK2, the third stage ST3 receives the third clock signal CLK3, the fourth stage ST4 receives the fourth clock signal CLK4, the fifth stage ST5 receives the fifth clock signal CLK5, the sixth stage ST6 receives the sixth clock signal CLK6, the seventh stage ST7 receives the seventh clock signal CLK7, and the eighth stage ST8 receives the eighth clock signal CLK8.

The first to eighth clock signals CLK1 to CLK8 are supplied to the scan driver 110 according to the embodiment of the present inventive concept and the first to eighth clock signals CLK1 to CLK8 are sequentially supplied to different stages ST. The stages ST1 to STn output the clock signal (one of CLK1 to CLK8) supplied thereto to the scan line S as a scan signal in response to control signals that are not shown.

Figure 3:
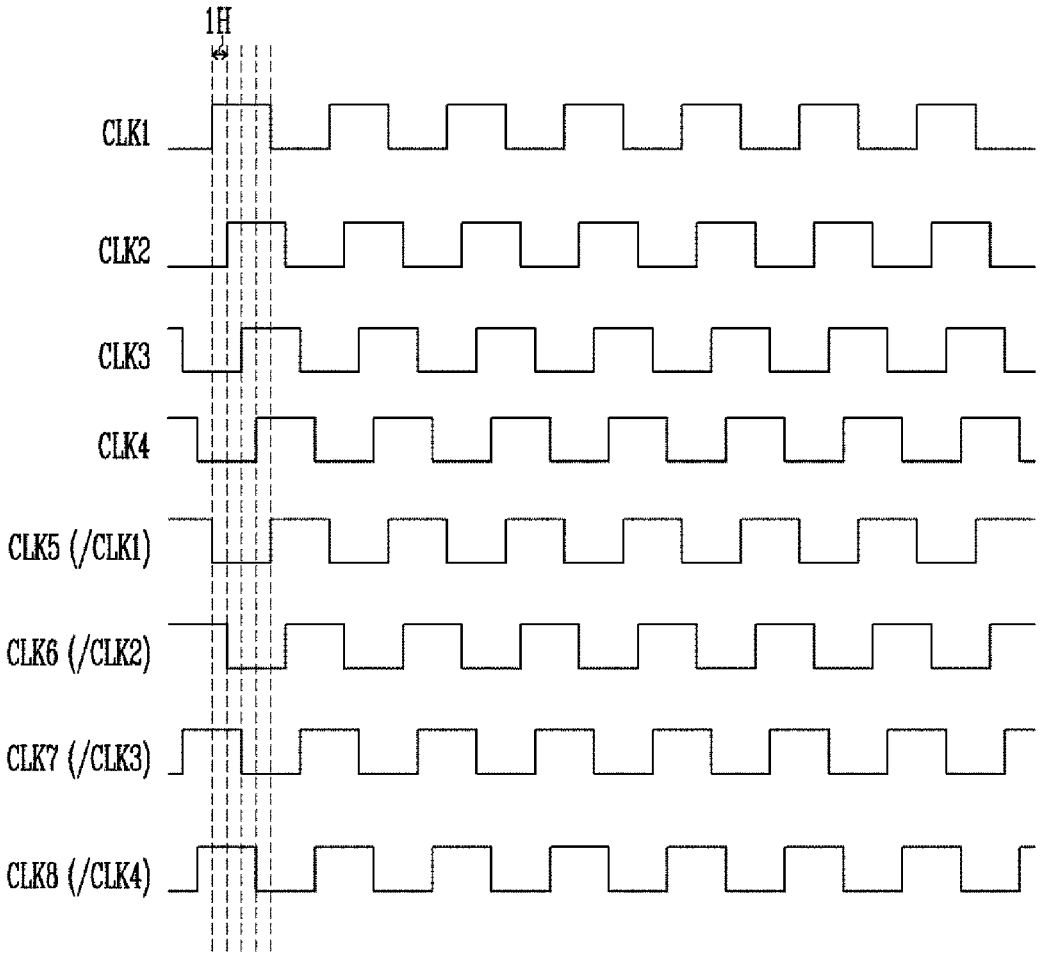
FIG. 3 is a view illustrating an embodiment of the clock signals of FIG. 2.

For this purpose, as illustrated in FIG. 3, the clock signals CLK1 to CLK8 are set to have the same period and different phases. For example, the clock signals CLK1 to CLK8 are set such that gate on voltages are supplied during a 4H period and gate off voltages are supplied during a 4H period. The jth clock signal (j is one of 2 to 8) is supplied to have a phase difference of 1H with a (j−1)th clock signal. In this case, the fifth clock signal CLK5 is an inverted clock signal of the first clock signal CLK1 which has a phase difference of 180 degrees than the first clock signal CLK1, the sixth clock signal CLK6 is an inverted clock signal of the second clock signal CLK2, the seventh clock signal CLK7 is an inverted clock signal of the third clock signal CLK3, and the eighth clock signal CLK8 is an inverted clock signal of the fourth clock signal CLK4.

Figure 4:
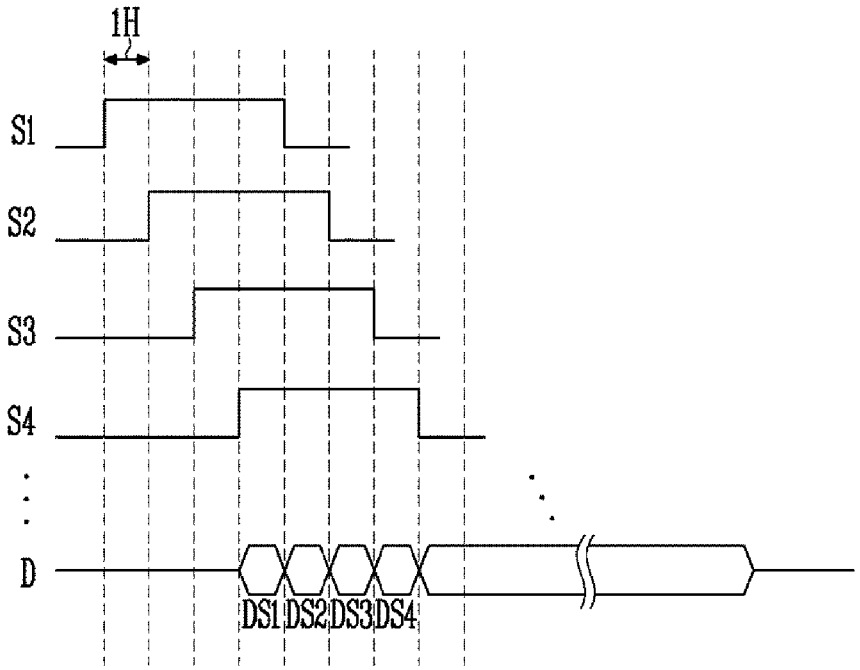
FIG. 4 is a view illustrating scan signals output from a scan driver and data signals output from a data driver.

When the clock signals CLK1 to CLK8 are set such that the gate on voltages are supplied during the 4H period, as illustrated in FIG. 4, the scan signals supplied to the scan lines S1 to Sn are supplied during the 4H period too. A scan signal supplied to a current scan line overlaps a scan signal supplied to a previous scan line during a 3H period.

The data driver 120 supplies a first data signal DS1 corresponding a first horizontal line during the last horizontal period of the first scan line S1 that is a one horizontal period just before falling edge of the first scan line S1. Then, the pixels connected to the first scan line S1 finally store a voltage of the first data signal DS1 to the storage capacitor SC so that the desired image may be displayed. The data driver 120 sequentially supplies a second data signal DS2 corresponding to a second horizontal line and a third data signal DS3 corresponding to a third horizontal line after the first data signal DS1 so that desired data signals may be supplied to the pixels 100.

The above-described scan driver according to the present inventive concept supplies the scan signals by using the eight clock signals CLK1 to CLK8. In this case, since the clock signals CLK1 to CLK8 are supplied to the respective scan lines once during eight scan signals are supplied, loads of the clock signals CLK1 to CLK8 may be minimized so that the scan driver may be applied to a large panel.

Figure 5:
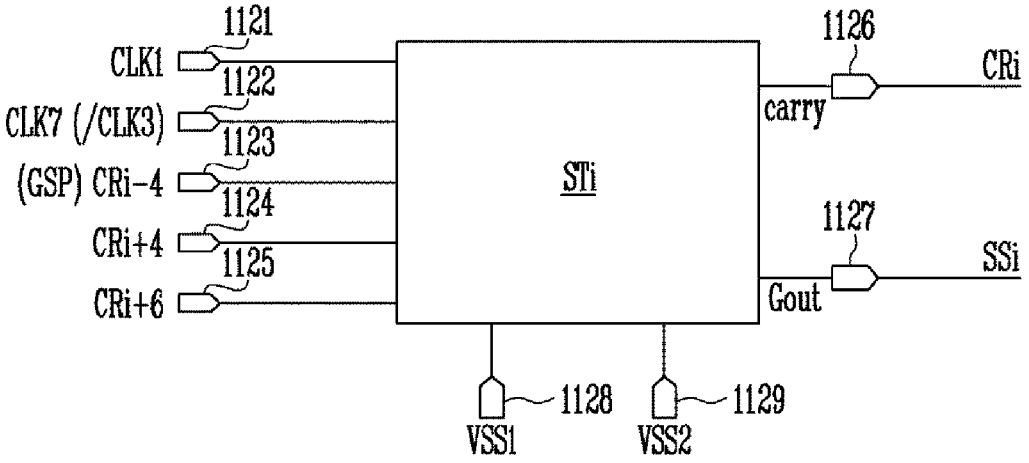
FIG. 5 is a view schematically illustrating terminals connected to the stage of FIG. 2.

FIG. 5 is a view schematically illustrating terminals connected to the stage of FIG. 2. In FIG. 5, for convenience sake, the ith stage STi is illustrated and it is assumed that the ith stage STi supplies the first clock signal CLK1 to a scan line.

Referring to FIG. 5, the ith stage STi includes first to fifth input terminals 1121 to 1125, a first output terminal 1126, a second output terminal 1127, a first power source input terminal 1128, and a second power source input terminal 1129.

The first input terminal 1121 receives a clock signal supplied to the scan line Si, that is, the first clock signal CLK1.

The second input terminal 1122 receives an inverted clock signal of the first clock signal CLK1. For example, the second input terminal 1122 receives one of the clock signals CLK6, CLK7, and CLK8 that maintain the gate on voltages when a voltage of the first clock signal CLK1 is rising from the gate off voltage to the gate on voltage. Then, for convenience sake, it is assumed that the seventh clock signal CLK7 is supplied to the second input terminal 1122.

The third input terminal 1123 receives a carry signal CR (or a gate start pulse GSP) of a previous stage, for example, an (i−4)th carry signal CRi−4.

The fourth input terminal 1124 and the fifth input terminal 1125 receive carry signals CR of subsequent stages. For example, the fourth input terminal 1124 may receive an (i+4)th carry signal CRi+4 and the fifth input terminal 1125 may receive an (i+6)th carry signal CRi+6. In addition, the same carry signal CR may be supplied to the fourth input terminal 1124 and the fifth input terminal 1125. In this case, the fourth input terminal 1124 or the fifth input terminal 1125 may be removed.

The first power source input terminal 1128 receives a first power source VSS1 and the second power source input terminal 1129 receives a second power source VSS2. Here, the first power source VS S1 and the second power source VS S2 are set to have different gate off voltages. In addition, according to the present inventive concept, the first power source VSS1 and the second power source VSS2 are used in order to completely turn off transistors. However, the present inventive concept is not limited thereto. For example, transistors connected to the second power source VSS2 may be connected to the first power source VSS1 without additionally supplying the second power source VSS2.

The first output terminal 1126 outputs a carry signal CRi and the second output terminal 1127 outputs a scan signal SSi.

Figure 6:
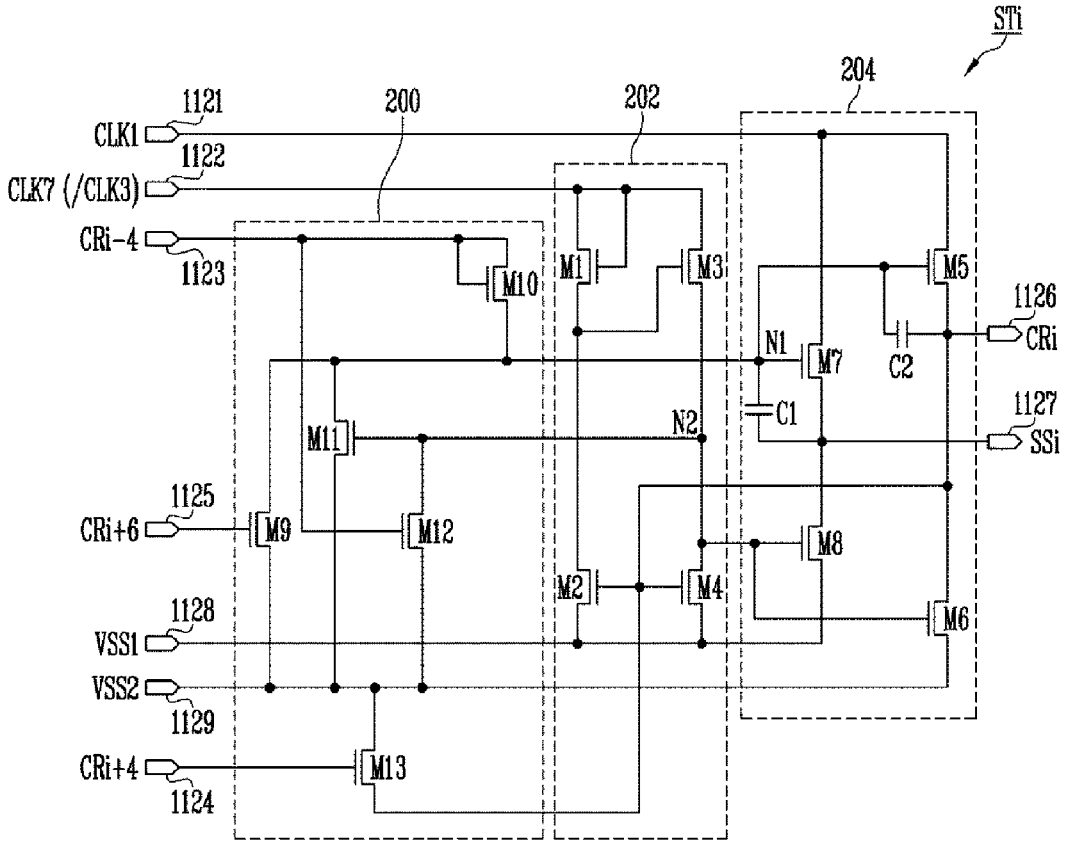
FIG. 6 is a circuit diagram illustrating the stage of FIG. 5 according to a first embodiment.

FIG. 6 is a circuit diagram illustrating the stage of FIG. 5 according to a first embodiment.

Referring to FIG. 6, the stage STi according to the first embodiment of the present inventive concept includes an input unit 200, a controller 202, and an output unit 204.

The output unit 204 outputs the carry signal CRi to the first output terminal 1126 and outputs the scan signal SSi to the second output terminal 1127 in response to the first clock signal CLK1 supplied to the first input terminal 1121 and voltages of a first node N1 and a second node N2.

For this purpose, the output unit 204 includes fifth to eighth transistors M5 to M8, a first capacitor C1, and a second capacitor C2.

A first electrode of the fifth transistor M5 is connected to the first input terminal 1121 and a second electrode of the fifth transistor M5 is connected to the first output terminal 1126. A gate electrode of the fifth transistor M5 is connected to the first node N1. The fifth transistor M5 is turned on or off in response to the voltage of the first node N1 and controls connection between the first input terminal 1121 and the first output terminal 1126.

A first electrode of the sixth transistor M6 is connected to the first output terminal 1126 and a second electrode of the sixth transistor M6 is connected to the second power source input terminal 1129. A gate electrode of the sixth transistor M6 is connected to the second node N2. The sixth transistor M6 is turned on or off in response to the voltage of the second node N2 and controls connection between the first output terminal 1126 and the second power source input terminal 1129.

A first electrode of the seventh transistor M7 is connected to the first input terminal 1121 and a second electrode of the seventh transistor M7 is connected to the second output terminal 1127. A gate electrode of the seventh transistor M7 is connected to the first node N1. The seventh transistor M7 is turned on or off in response to the voltage of the first node N1 and controls connection between the first input terminal 1121 and the second output terminal 1127.

A first electrode of the eighth transistor M8 is connected to the second output terminal 1127 and a second electrode of the eighth transistor M8 is connected to the first power source input terminal 1128. A gate electrode of the eighth transistor M8 is connected to the second node N2. The eighth transistor M8 is turned on or off in response to the voltage of the second node N2 and controls connection between the second output terminal 1127 and the first power source input terminal 1128.

The first capacitor C1 is connected between the first node N1 and the second output terminal 1127. The first capacitor C1 functions as a boosting capacitor. That is, the first capacitor C1 increases the voltage of the first node N1 in response to increase in voltage of the second output terminal 1127 when the seventh transistor M7 is turned on so that the seventh transistor M7 stably maintains a turn on state.

The second capacitor C2 is connected between the first node N1 and the first output terminal 1126. The second capacitor C2 increases the voltage of the first node N1 in response to increase in voltage of the first output terminal 1126 when the fifth transistor M5 is turned on so that the fifth transistor M5 stably maintains a turn on state.

The controller 202 controls the voltage of the second node N2 by using the seventh clock signal CLK7 supplied to the second input terminal 1122.

For this purpose, the controller 202 includes first to fourth transistors M1 to M4.

A first electrode and a gate electrode of the first transistor M1 are connected to the second input terminal 1122 and a second electrode of the first transistor M1 is connected to a first electrode of the second transistor M2 and a gate electrode of the third transistor M3. The first transistor M1 is diode connected and is turned on when the seventh clock signal CLK7 is supplied to the second input terminal 1122.

A first electrode of the second transistor M2 is connected to the second electrode of the first transistor M1 and a second electrode of the second transistor M2 is connected to the first power source input terminal 1128. A gate electrode of the second transistor M2 is connected to the first output terminal 1126 and a 13$^{th}$ transistor M13 included in the input unit 200. The second transistor M2 is turned on or off in response to voltages supplied from the first output terminal 1126 and the 13$^{th}$ transistor M13.

A first electrode of the third transistor M3 is connected to the second input terminal 1122 and a second electrode of the third transistor M3 is connected to the second node N2. A gate electrode of the third transistor M3 is connected to the second electrode of the first transistor M1. The third transistor M3 is turned on or off in response to a voltage supplied from the second electrode of the first transistor M1 and controls connection between the second input terminal 1122 and the second node N2.

A first electrode of the fourth transistor M4 is connected to the second node N2 and a second electrode of the fourth transistor M4 is connected to the first power source input terminal 1128. A gate electrode of the fourth transistor M4 is connected to the first output terminal 1126 and the 13$^{th}$ transistor M13 included in the input unit 200. The fourth transistor M4 is turned on or off in response to the voltages supplied from the first output terminal 1126 and the 13$^{th}$ transistor M13.

The input unit 200 controls the voltages of the first node N1 and the second node N2 in response to the (i−4)th carry signal CRi−4 input to the third input terminal 1123, the (i+4)th carry signal CRi+4 supplied to the fourth input terminal 1124, and the (i+6)th carry signal CRi+6 supplied to the fifth input terminal 1125.

For this purpose, the input unit 200 includes ninth to 13$^{th}$ transistors M9 to M13.

A first electrode of the ninth transistor M9 is connected to the first node N1 and a second electrode of the ninth transistor M9 is connected to the second power source input terminal 1129. A gate electrode of the ninth transistor M9 is connected to the fifth input terminal 1125. The ninth transistor M9 is turned on when the (i+6)th carry signal CRi+6 is supplied to the fifth input terminal 1125 and supplies a voltage of the second power source VSS2 to the first node N1.

A first electrode and a gate electrode of the tenth transistor M10 are connected to the third input terminal 1123 and a second electrode of the tenth transistor M10 is connected to the first node N1. The tenth transistor M10 is diode connected and is turned on when the (i−4)th carry signal CRi−4 is supplied to the third input terminal 1123.

A first electrode of the 11$^{th}$ transistor M11 is connected to the first node N1 and a second electrode of the 11$^{th}$ transistor M11 is connected to the second power source input terminal 1129. A gate electrode of the 11$^{th}$ transistor M11 is connected to the second node N2. The 11$^{th}$ transistor M11 is turned on or off in response to the voltage of the second node N2 and controls connection between the first node N1 and the second power source input terminal 1129.

A first electrode of the 12$^{th}$ transistor M12 is connected to the second node N2 and a second electrode of the 12$^{th}$ transistor M12 is connected to the second power source input terminal 1129. A gate electrode of the 12$^{th}$ transistor M12 is connected to the third input terminal 1123. The 12$^{th}$ transistor M12 is turned on when the (i−4)th carry signal CRi−4 is supplied to the third input terminal 1123 and supplies the voltage of the second power source VSS2 to the second node N2.

A first electrode of the 13$^{th}$ transistor M13 is connected to the second power source input terminal 1129 and a second electrode is connected to the first output terminal 1126. A gate electrode of the 13$^{th}$ transistor M13 is connected to the fourth input terminal 1124. The 13$^{th}$ transistor M13 is turned on when the (i+4)th carry signal CRi+4 is supplied to the fourth input terminal 1124 and supplies the voltage of the second power source VSS2 to the first output terminal 1126.

Figure 7:
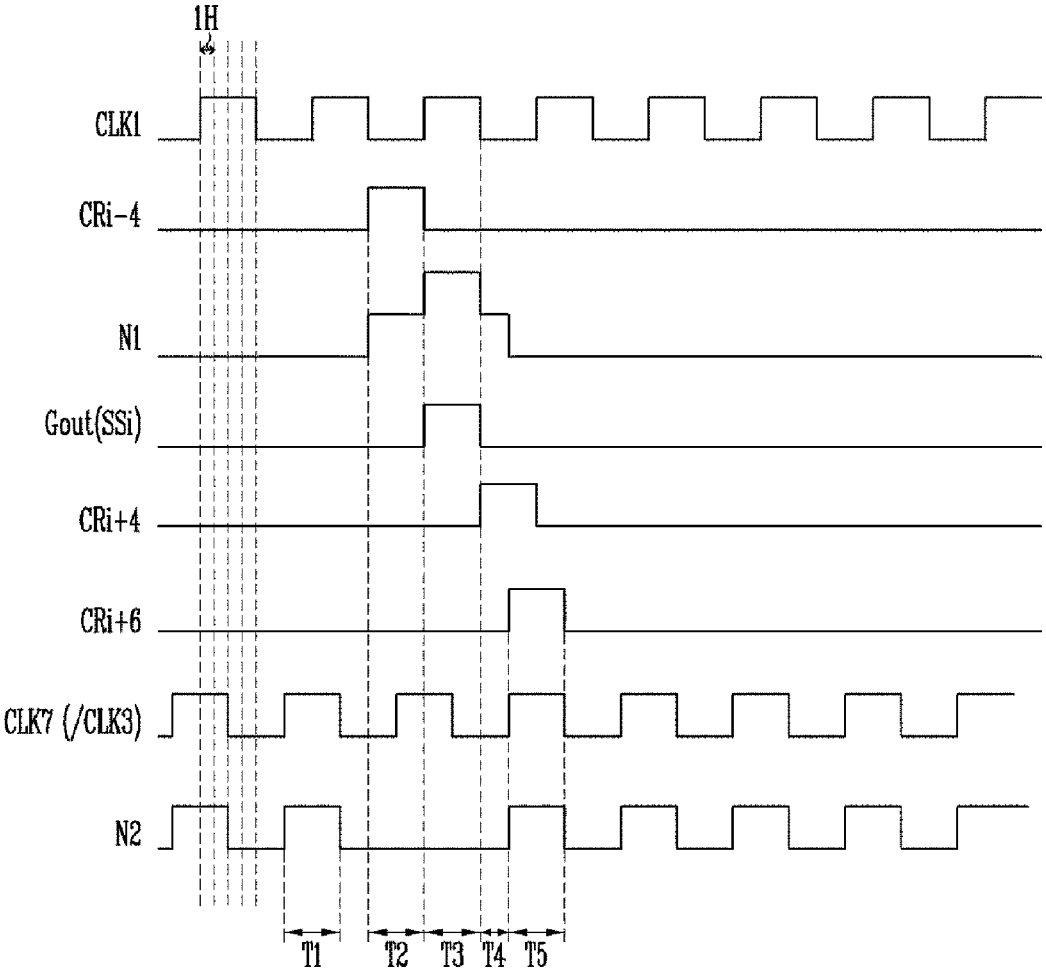
FIG. 7 is a waveform diagram illustrating a method of driving the stage circuit of FIG. 6.

FIG. 7 is a waveform diagram illustrating a method of driving the stage circuit of FIG. 6. Hereinafter, that the clock signals and the carry signals are supplied means a gate on voltage is supplied and that supply of the clock signals and the carry signals is stopped means a gate off voltage is supplied.

Referring to FIG. 7, the seventh clock signal CLK7 is supplied to the second input terminal 1122 in a first period T1. When the seventh clock signal CLK7 is supplied to the second input terminal 1122 (that is, the gate on voltage), the first transistor M1 is turned on. When the first transistor M1 is turned on, the seventh clock signal CLK7 is supplied to the gate electrode of the third transistor M3 so that the third transistor M3 is turned on.

When the third transistor M3 is turned on, the seventh clock signal CLK7 is supplied to the second node N2. When the seventh clock signal CLK7 is supplied to the second node N2, the sixth transistor M6, the eighth transistor M8, and the 11$^{th}$ transistor M11 are turned on. When the sixth transistor M6 is turned on, the voltage of the second power source VSS2 is supplied to the first output terminal 1126. When the eighth transistor M8 is turned on, the voltage of the first power source VSS1 is supplied to the second output terminal 1127. When the 11$^{th}$ transistor M11 is turned on, the voltage of the second power source VSS2 is supplied to the first node N1. When the voltage of the second power source VSS2 is supplied to the first node N1, the fifth transistor M5 and the seventh transistor M7 are set in a turn off state.

Here, when the voltage of the first power source VSS1 is set to be higher than that of the second power source VSS2, the seventh transistor M7 is completely turned off so that a leakage current may be minimized. In addition, since the fifth transistor M5 and the seventh transistor M7 are set in the turn off state in the first period T1, regardless of the first clock signal CLK1 supplied to the first input terminal 1121, the first output terminal 1126 and the second output terminal 1127 maintain gate off voltages.

In a second period T2, the (i−4)th carry signal CRi−4 is supplied to the third input terminal 1123 so that the tenth transistor M10 and the 12$^{th}$ transistor M12 are turned on. When the tenth transistor M10 is turned on, the (i−4)th carry signal CRi−4 is supplied to the first node N1. When the (i−4)th carry signal CRi−4 is supplied to the first node N1, the fifth transistor M5 and the seventh transistor M7 are turned on. At this time, a voltage corresponding to turning on of the seventh transistor M7 is stored in the first capacitor C1 and a voltage corresponding to turning on of the fifth transistor M5 is stored in the second capacitor C2.

When the 12$^{th}$ transistor M12 is turned on, the voltage of the second power source VSS2 is supplied to the second node N2 so that the sixth transistor M6 and the eighth transistor M8 are turned off. On the other hand, in the latter half period of the second period T2, the seventh clock signal CLK7 is supplied so that the first transistor M1 and the third transistor M3 are turned on. When the third transistor M3 is turned on, the seventh clock signal CLK7 is supplied to the second node N2. In this case, the seventh clock signal CLK7 is supplied to the second node N2 via the third transistor M3 and the voltage of the second power source VSS2 is supplied to the second node N2 via the 12$^{th}$ transistor M12.

For this purpose, according to the present inventive concept, a channel width/a length (W/L) of the 12$^{th}$ transistor M12 may be set to be larger than that of the third transistor M3 to discharge the seventh clock signal CLK7 supplied via the third transistor to the second power source VSS2. Then, the second node N2 may stably maintain the voltage of the second power source VSS2 in the second period T2.

In a third period T3, the first clock signal CLK1 is supplied to the first input terminal 1121. At this time, since the fifth transistor M5 and the seventh transistor M7 are set in turn on states, the first clock signal CLK1 supplied to the first input terminal 1121 is supplied to the first output terminal 1126 and the second output terminal 1127. Here, the first clock signal CLK1 supplied to the first output terminal 1126 is supplied to previous and next stages as the carry signal CRi. The first clock signal CLK1 supplied to the second output terminal 1127 is supplied to the scan line Si as the scan signal SSi.

When the first clock signal CLK1 is supplied to the first output terminal 1126, the second transistor M2 and the fourth transistor M4 are turned on. When the second transistor M2 is turned on, the first power source VSS1 is supplied to the gate electrode of the third transistor M3. When the fourth transistor M4 is turned on, the voltage of the first power source VSS1 is supplied to the second node N2. Then, although the $12^{th}$ transistor M12 is turned off in the third period T3, the second node N2 is maintained as a gate off voltage. (For this purpose, W/L of the fourth transistor M4 may be set to be larger than that of the third transistor M3.)

In addition, when the first clock signal CLK1 is supplied to the first output terminal 1126 and the second output terminal 1127, the voltage of the first node N1 is increased by the first capacitor C1 and the second capacitor C2 so that the fifth transistor M5 and the seventh transistor M7 stably maintain the turn on states.

In a fourth period T4, the (i+4)th carry signal CRi+4 is supplied to the fourth input terminal 1124. When the (i+4)th carry signal CRi+4 is supplied to the fourth input terminal 1124, the $13^{th}$ transistor M13 is turned on. When the $13^{th}$ transistor M13 is turned on, the voltage of the second power source VSS2 is supplied to the gate electrodes of the second transistor M2 and the fourth transistor M4 and the first output terminal 1126. Then, the second transistor M2 and the fourth transistor M4 are turned off and the first output terminal 1126 is initialized to the voltage of the second power source VSS2.

In a fifth period T5, the (i+6)th carry signal CRi+6 is supplied to the fifth input terminal 1125 and the seventh clock signal CLK7 is supplied to the second input terminal 1122. When the (i+6)th carry signal CRi+6 is supplied to the fifth input terminal 1125, the ninth transistor M9 is turned on. When the ninth transistor M9 is turned on, the voltage of the second power source VSS2 is supplied to the first node N1 so that the fifth transistor M5 and the seventh transistor M7 are turned off.

When the seventh clock signal CLK7 is supplied to the second input terminal 1122, the first transistor M1 and the third transistor M3 are turned on so that the seventh clock signal CLK7 is supplied to the second node N2. When the seventh clock signal CLK7 is supplied to the second node N2, the voltage of the second power source VSS2 is supplied to the first output terminal 1126 in response to turning on of the sixth transistor M6 and the voltage of the first power source VSS1 is supplied to the second output terminal 1127 in response to turning on of the eighth transistor M8.

After the fifth period T5, the (i−4)th carry signal CRi−4 is not supplied so that the first output terminal 1126 and the second output terminal 1127 maintain gate off voltages regardless of supply of the first clock signal CLK1.

According to the above-described present inventive concept, the second input terminal 1122 receives one of the clock signals CLK6, CLK7, and CLK8 that maintain high voltages when a voltage of the first clock signal CLK1 is rising from the gate off voltage to the gate on voltage. Then, the voltage of the second node N2 is increased to a gate on voltage before the first clock signal CLK1 is supplied so that the sixth transistor M6 and the eighth transistor M8 are turned on before the first clock signal CLK1 is supplied.

When the sixth transistor M6 is turned on, the voltage of the second power source VSS2 is supplied to the second electrode of the fifth transistor M5. When the eighth transistor M8 is turned on, the voltage of the first power source VSS1 is supplied to the second electrode of the seventh transistor M7.

That is, the first clock signal CLK1 is supplied after gate off voltages are supplied to the second electrode of the fifth transistor M5 and the second electrode of the seventh transistor M7. Then, the voltage of the first node N1 is not changed by a ripple voltage generated by supply of the first clock signal CLK1 so that stability of an operation may be secured.

In addition, since the voltage of the first node N1 may be stably maintained, capacities of the first capacitor C1 and the second capacitor C2 that are used as boosting capacitors may be minimized so that a size of a circuit may be reduced. When the first clock signal CLK1 is supplied, the second node N2 stably maintains a gate on voltage so that it is possible to prevent the circuit from erroneously operating due to signal delay.

On the other hand, in the above-described description, carry signals CR supplied to the fourth input terminal 1124 and the fifth input terminal 1126 may be variously set in a range in which the carry signals CR do not affect the operation of the circuit.

In addition, in FIG. 7, it is illustrated that the voltage of the second node N2 is increased to a gate on voltage and is reduced to a gate off voltage like the seventh clock signal CLK7 after the fifth period T5, which is ideal. Actually, after the fifth period T5, the voltage of the second node N2 is slowly increased to the gate on voltage or is slowly reduced to the gate off voltage by delay of the circuit.

Figure 8:
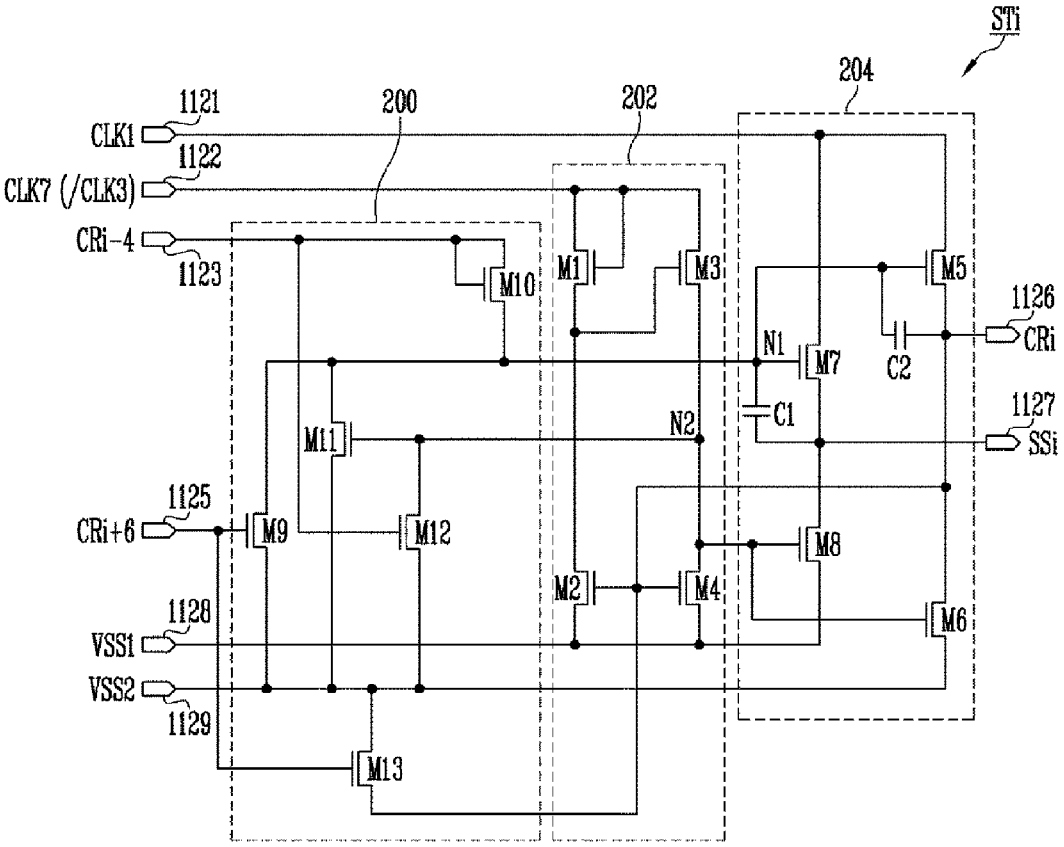
FIG. 8 is a circuit diagram illustrating the stage of FIG. 5 according to a second embodiment.

FIG. 8 is a circuit diagram illustrating the stage of FIG. 5 according to a second embodiment.

Referring to FIG. 8, the gate electrode of the $13^{th}$ transistor M13 according to the second embodiment of the present inventive concept is connected to the fifth input terminal 1125. In this case, the $13^{th}$ transistor M13 is turned on when the (i+6)th carry signal CRi+6 is supplied to the fifth input terminal 1125. When the $13^{th}$ transistor M13 is turned on, the voltage of the second power source VSS2 is supplied to the gate electrodes of the second transistor M2 and the fourth transistor M4 and the first output terminal 1126. Then, the second transistor M2 and the fourth transistor M4 are turned off and the first output terminal 1126 is initialized to the voltage of the second power source VSS2.

In the second embodiment of the present inventive concept, the $13^{th}$ transistor M13 actually performs the same function as that in the first embodiment of the present inventive concept. Therefore, description of operation processes will not be given and like reference numerals refer to like elements.

Figure 9:
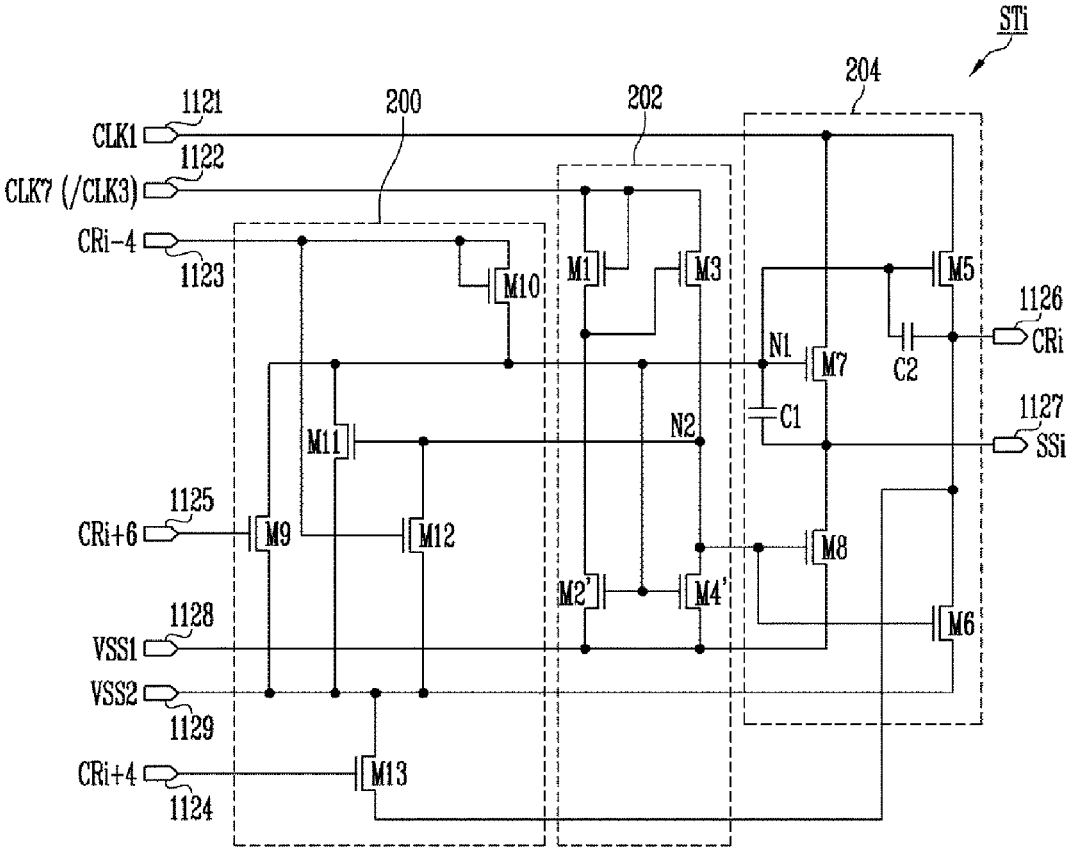
FIG. 9 is a circuit diagram illustrating the stage of FIG. 5 according to a third embodiment.

FIG. 9 is a circuit diagram illustrating the stage of FIG. 5 according to a third embodiment.

Referring to FIG. 9, the stage STi according to the third embodiment of the present inventive concept includes a second transistor M2' and a fourth transistor M4' of which gate electrodes are connected to the first node N1. In this case, the second transistor M2' and the fourth transistor M4' are turned on when a gate on voltage is supplied to the first node N1.

When the second transistor M2' is turned on, the voltage of the first power source VSS1 is supplied to the gate electrode of the third transistor M3. When the fourth transistor M4' is turned on, the voltage of the first power source VSS1 is supplied to the second node N2.

That is, in the third embodiment of the present inventive concept, when the gate on voltage is supplied to the first node N1, the second node N2 is set to have a gate off voltage so that stability of driving may be secured.

Figure 10:
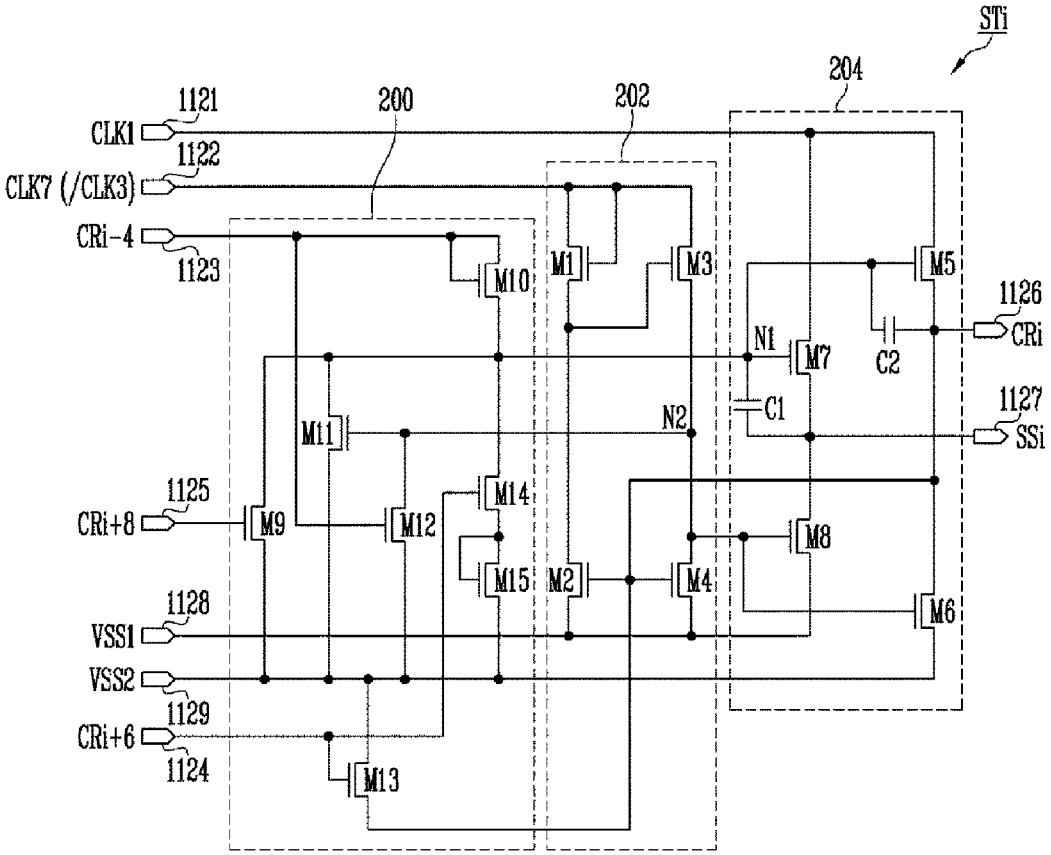
FIG. 10 is a circuit diagram illustrating the stage of FIG. 5 according to a fourth embodiment.

FIG. 10 is a circuit diagram illustrating the stage of FIG. 5 according to a fourth embodiment.

Referring to FIG. 10, the (i+6)th carry signal CRi+6 is supplied to the fourth input terminal 1124 of the stage STi according to the fourth embodiment of the present inventive concept and the (i+8)th carry signal CRi+8 is supplied to the fifth input terminal 1125.

The stage STi according to the fourth embodiment of the present inventive concept includes a $14^{th}$ transistor M14 and a $15^{th}$ transistor M15 that are serially connected between the first node N1 and the second power source input terminal 1129.

A gate electrode of the $14^{th}$ transistor M14 is connected to the fourth input terminal 1124. That is, the $14^{th}$ transistor M14 is turned on when the (i+6)th carry signal CRi+6 is supplied to the fourth input terminal 1124.

A first electrode and a gate electrode of the $15^{th}$ transistor M15 are connected to a second electrode of the $14^{th}$ transistor M14 and a second electrode of the $15^{th}$ transistor M15 is connected to the second power source VSS2. That is, the $15^{th}$ transistor M15 is diode connected so that a current may flow from the $14^{th}$ transistor M14 to the second power source VSS2.

That is, the $14^{th}$ transistor M14 and the $15^{th}$ transistor M15 reduce the voltage of the first node N1 approximately to the voltage of the second power source VSS2 when the (i+6)th carry signal CRi+6 is supplied.

Figure 11:
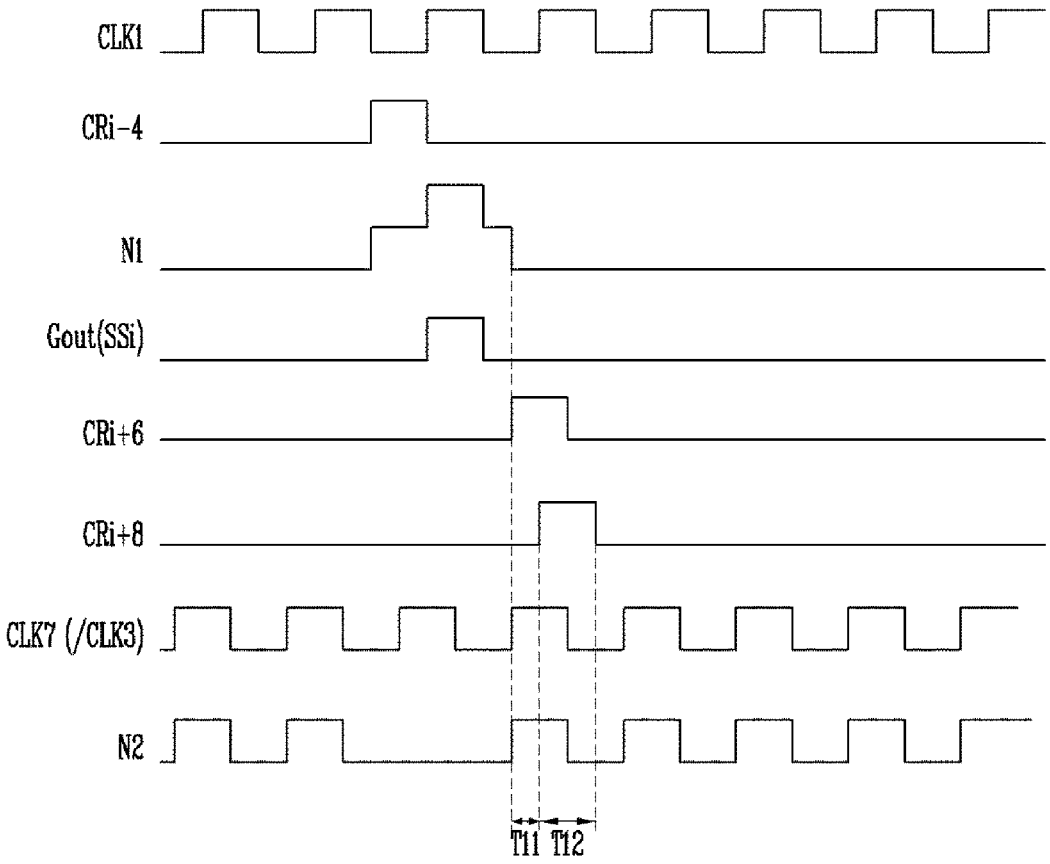
FIG. 11 is a waveform diagram illustrating a method of driving the stage circuit of FIG. 10.

FIG. 11 is a waveform diagram illustrating a method of driving the stage circuit of FIG. 10. In FIG. 11, description of the same elements as those of FIG. 7 will not be given.

Referring to FIG. 11, in an $11^{th}$ period T11, the (i+6)th carry signal CRi+6 is supplied to the fourth input terminal 1124 and the seventh clock signal CLK7 is supplied to the second input terminal 1122.

When the (i+6)th carry signal CRi+6 is supplied to the fourth input terminal 1124, the $13^{th}$ transistor M13 and the $14^{th}$ transistor M14 are turned on. When the $13^{th}$ transistor M13 is turned on, the voltage of the second power source VSS2 is supplied to the gate electrodes of the second transistor M2 and the fourth transistor M4 and the first output terminal 1126. Then, the second transistor M2 and the fourth transistor M4 are turned off and the first output terminal 1126 is initialized to the voltage of the second power source VSS2.

When the $14^{th}$ transistor M14 is turned on, the first node N1 and the $15^{th}$ transistor M15 are electrically connected. At this time, since the $15^{th}$ transistor M15 is diode connected, the voltage of the first node N1 is reduced approximately to the voltage of the second power source VSS2.

When the seventh clock signal CLK7 is supplied to the second input terminal 1122, the first transistor M1 and the third transistor M3 are turned on so that the seventh clock signal CLK7 is supplied to the second node N2. When the seventh clock signal CLK7 is supplied to the second node N2, the sixth transistor M6, the eighth transistor M8, and the $11^{th}$ transistor M11 are turned on.

When the sixth transistor M6 is turned on, the voltage of the second power source VSS2 is supplied to the first output terminal 1126. When the eighth transistor M8 is turned on, the voltage of the first power source VSS1 is supplied to the second output terminal 1127. When the $11^{th}$ transistor M11 is turned on, the voltage of the second power source VSS2 is supplied to the first node N1.

Then, in a $12^{th}$ period T12, the (i+8)th carry signal CRi+8 is supplied to the fifth input terminal 1125. When the (i+8)th carry signal CRi+8 is supplied to the fifth input terminal 1125, the ninth transistor M9 is turned on. When the ninth transistor M9 is turned on, the voltage of the second power source VSS2 is supplied to the first node N1. Therefore, although the first clock signal CLK1 is supplied to the first input terminal 1121 in the $12^{th}$ period T12, the first output terminal 1126 and the second output terminal 1127 maintain gate off voltages.

Figure 12:
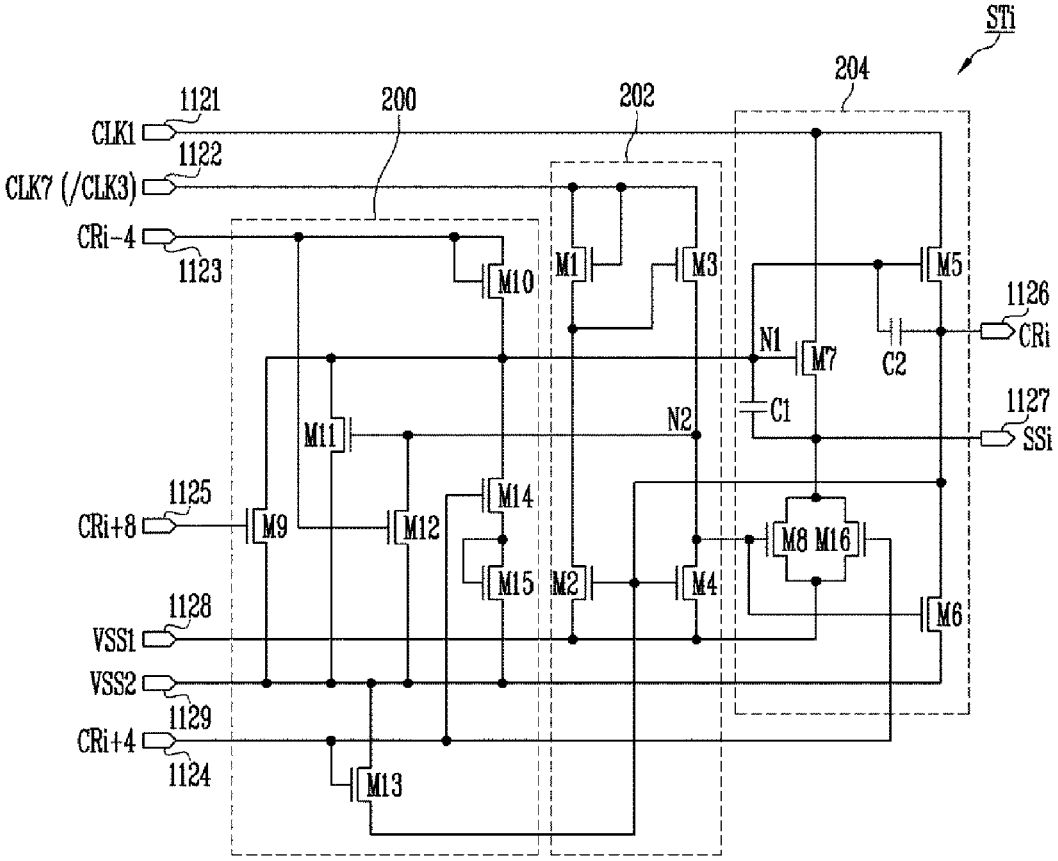
FIG. 12 is a circuit diagram illustrating the stage of FIG. 5 according to a fifth embodiment.

FIG. 12 is a circuit diagram illustrating the stage of FIG. 5 according to a fifth embodiment. In the stage STi of FIG. 12, parts different from those of the stage circuit of FIG. 10 will be mainly described.

Referring to FIG. 12, the (i+4)th carry signal CRi+4 is supplied to the fourth input terminal 1124 of the stage STi according to the fifth embodiment of the present inventive concept.

The stage STi according to the fifth embodiment of the present inventive concept includes a $16^{th}$ transistor M16 connected between the second output terminal 1127 and the first power source input terminal 1128. The $16^{th}$ transistor M16 is turned on when the (i+4)th carry signal CRi+4 is supplied to the fourth input terminal 1124 and supplies the voltage of the first power source VSS1 to the second output terminal 1127.

In the fifth embodiment of the present inventive concept, the $16^{th}$ transistor M16 is added and a voltage of the second output terminal 1127 is stably initialized by using the added $16^{th}$ transistor M16.

Figure 13:
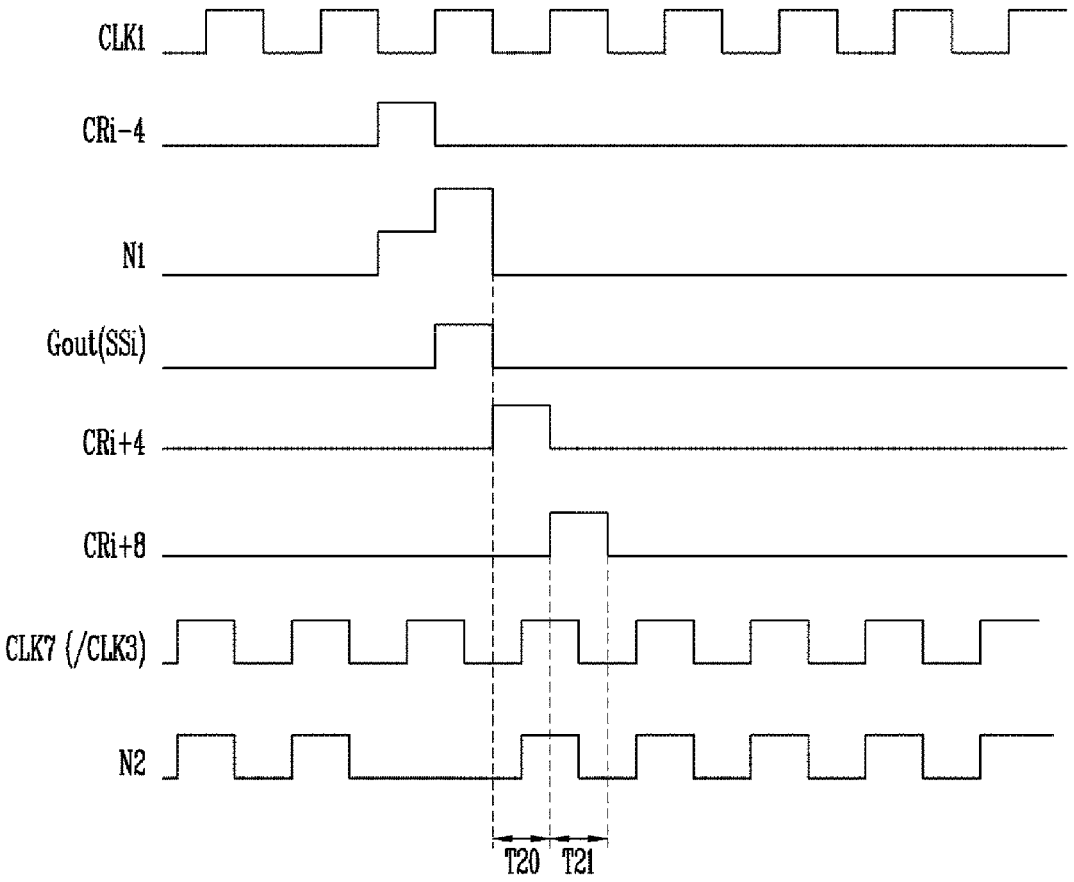
FIG. 13 is a waveform diagram illustrating a method of driving the stage circuit of FIG. 12.

FIG. 13 is a waveform diagram illustrating a method of driving the stage circuit of FIG. 12. In FIG. 13, description of the same elements as those of FIG. 7 will not be given.

Referring to FIG. 13, in a $20^{th}$ period T20, the (i+4)th carry signal CRi+4 is supplied to the fourth input terminal 1124. When the (i+4)th carry signal CRi+4 is supplied to the fourth input terminal 1124, the $13^{th}$ transistor M13, the $14^{th}$ transistor M14, and the $16^{th}$ transistor M16 are turned on.

When the $13^{th}$ transistor M13 is turned on, the voltage of the second power source VSS2 is supplied to the gate electrodes of the second transistor M2 and the fourth transistor M4 and the first output terminal 1126. Then, the second transistor M2 and the fourth transistor M4 are turned off and the first output terminal 1126 is initialized to the voltage of the second power source VSS2.

When the $14^{th}$ transistor M14 is turned on, the first node N1 and the $15^{th}$ transistor M15 are electrically connected. At this time, since the $15^{th}$ transistor M15 is diode connected, the voltage of the first node N1 is reduced about to the voltage of the second power source VSS2.

When the $16^{th}$ transistor M16 is turned on, the voltage of the first power source VSS1 is supplied to the second output terminal 1127. Then, the second output terminal 1127 is initialized to the voltage of the first power source VSS1 in the $20^{th}$ period T20.

In addition, in the latter half period of the $20^{th}$ period T20, the seventh clock signal CLK7 is supplied to the second input terminal 1122 so that the first transistor M1 and the third transistor M3 are turned on. Then, the seventh clock signal CLK7 is supplied to the second node N2 so that the sixth transistor M6, the eighth transistor M8, and the $11^{th}$ transistor M11 are turned on.

When the sixth transistor M6 is turned on, the voltage of the second power source VSS2 is supplied to the first output terminal 1126. When the eighth transistor M8 is turned on, the voltage of the first power source VSS1 is supplied to the second output terminal 1127. When the $11^{th}$ transistor M11 is turned on, the voltage of the second power source VSS2 is supplied to the first node N1.

Then, in a $21^{st}$ period T21, the (i+8)th carry signal CRi+8 is supplied to the fifth input terminal 1125. When the (i+8)th carry signal CRi+8 is supplied to the fifth input terminal 1125, the ninth transistor M9 is turned on. When the ninth transistor M9 is turned on, the voltage of the second power source VSS2 is supplied to the first node N1. Therefore, although the first clock signal CLK1 is supplied to the first input terminal 1121 in the $21^{st}$ period T21, the first output terminal 1126 and the second output terminal 1127 maintain gate off voltages.

Figure 14:
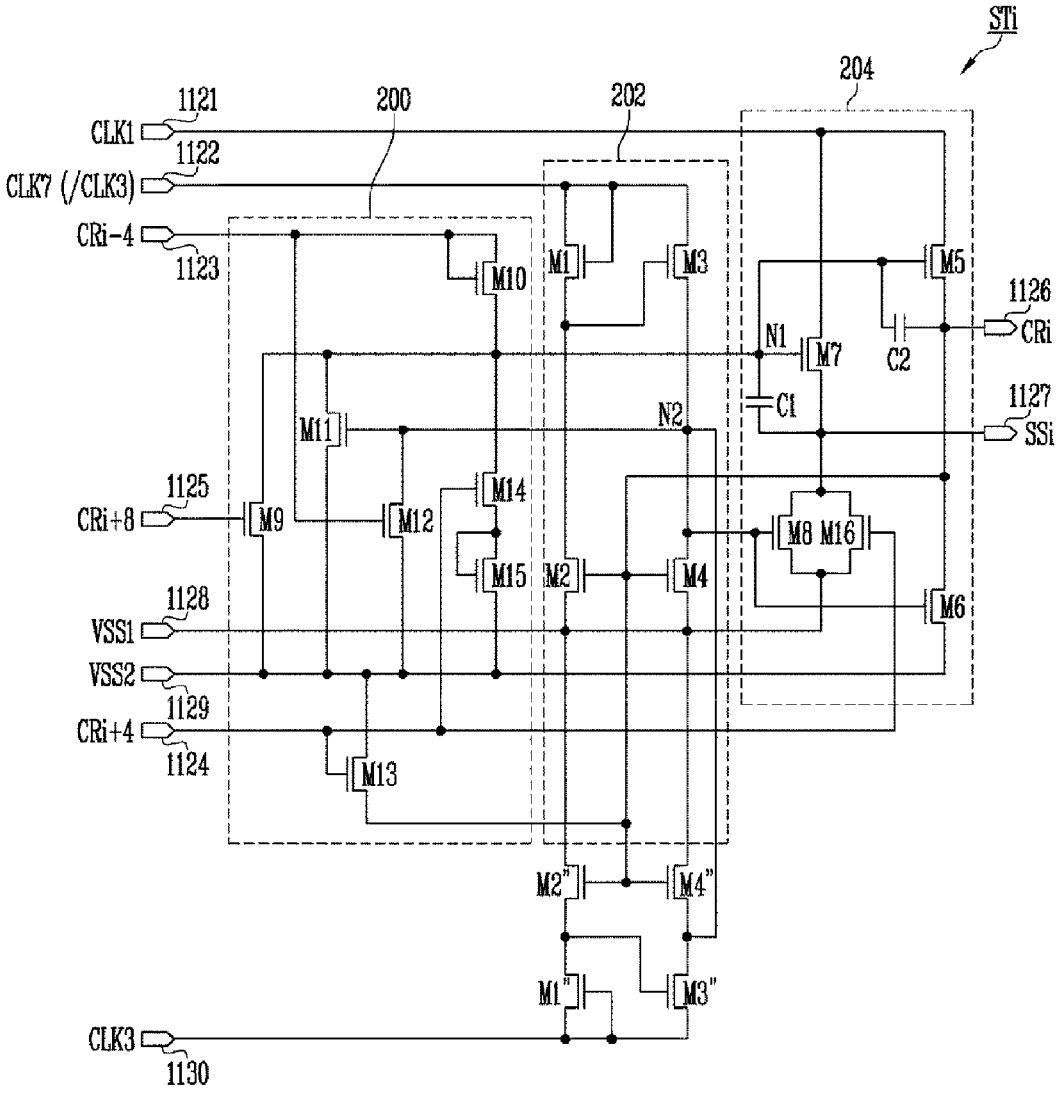
FIG. 14 is a circuit diagram illustrating the stage of FIG. 5 according to a sixth embodiment.

FIG. 14 is a circuit diagram illustrating the stage of FIG. 5 according to a sixth embodiment. In the stage STi of FIG. 14, parts different from those of the stage circuit of FIG. 12 will be mainly described.

Referring to FIG. 14, the stage STi according to the sixth embodiment of the present inventive concept additionally includes a second first transistor M1", a second second transistor M2", a second third transistor M3", and a second fourth transistor M4" in order to stabilize the voltage of the second node N2. The second transistors M1" to M4" have a different turn-on time with the first transistors M1 to M4 and control the voltage of the second node N2.

On the other hand, in FIG. 14, it is illustrated that the second transistors M1" to M4" are added to the circuit according to the fifth embodiment of the present inventive concept. However, the present inventive concept is not limited thereto. For example, the second first to fourth transistors M1" to M4" may be added to the circuits according to the first to fourth embodiments.

A first electrode and a gate electrode of the second first transistor M1" are connected to a control input terminal 1130 and a second electrode the second first transistor M1" is connected to a first electrode of the second second transistor M2".

The second first transistor M1" is diode connected and is turned on when a clock signal is supplied to the control input terminal. Here, the control input terminal 1130 is added in order to stabilize the second node N2. The control input terminal 1130 receives the third clock signal CLK3 which is inverted clock signal of the seventh clock signal supplied to the second input terminal 1122.

A first electrode of the second second transistor M2" is connected to the second electrode of the second first transistor M1" and a second electrode of the second second transistor M2" is connected to the first power source input terminal 1128. A gate electrode of the second second transistor M2" is connected to the first output terminal 1126.

A first electrode of the second third transistor M3" is connected to the control input terminal 1130 and a second electrode of the second third transistor M3" is connected to a first electrode of the second fourth transistor M4" and the second node N2. A gate electrode of the second third transistor M3" is connected to the second electrode of the second first transistor M1".

A first electrode of the second fourth transistor M4" is connected to the second node N2 and a second electrode of the second fourth transistor M4" is connected to the first power source input terminal 1128. A gate electrode of the second fourth transistor M4" is connected to the first output terminal 1126.

Figure 15:
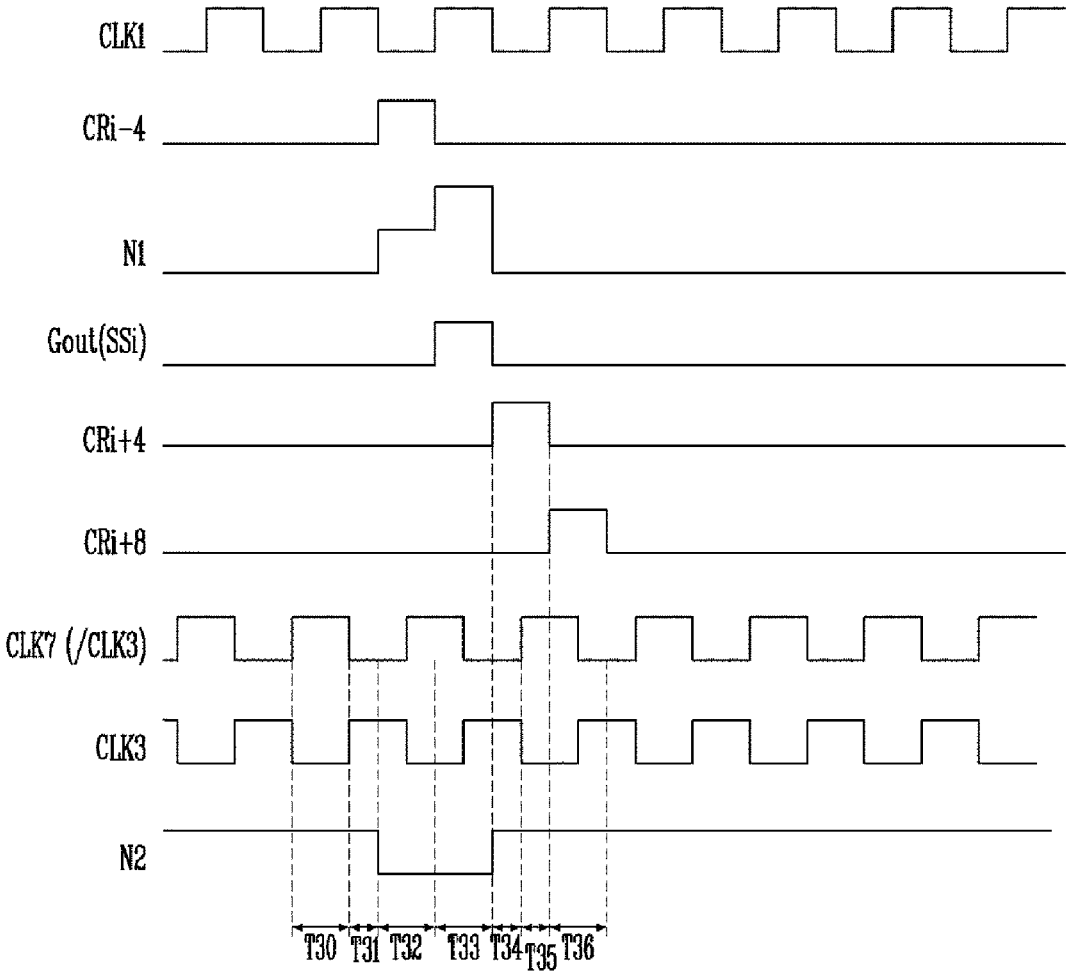
FIG. 15 is a waveform diagram illustrating a method of driving the stage circuit of FIG. 14.

FIG. 15 is a waveform diagram illustrating a method of driving the stage circuit of FIG. 14.

Referring to FIG. 15, first, in a $30^{th}$ period T30, the seventh clock signal CLK7 is supplied to the second input terminal 1122. When the seventh clock signal CLK7 is supplied to the second input terminal 1122, the first transistor M1 is turned on. When the first transistor M1 is turned on, the seventh clock signal CLK7 is supplied to the gate electrode of the third transistor M3 so that the third transistor M3 is turned on.

When the third transistor M3 is turned on, the seventh clock signal CLK7 is supplied to the second node N2. When the seventh clock signal CLK7 is supplied to the second node N2, the sixth transistor M6, the eighth transistor M8, and the $11^{th}$ transistor M11 are turned on. When the sixth transistor M6 is turned on, the voltage of the second power source VSS2 is supplied to the first output terminal 1126. When the eighth transistor M8 is turned on, the voltage of the first power source VSS1 is supplied to the second output terminal 1127. When the $11^{th}$ transistor M11 is turned on, the voltage of the second power source VSS2 is supplied to the first node N1. When the voltage of the second power source VSS2 is supplied to the first node N1, the fifth transistor M5 and the seventh transistor M7 are set in turn off states.

In addition, since the fifth transistor M5 and the seventh transistor M7 are set in the turn off states in the $30^{th}$ period T30, regardless of the first clock signal CLK1 supplied to the first input terminal 1121, the first output terminal 1126 and the second output terminal 1127 maintain gate off voltages.

In a $31^{st}$ period T31, the third clock signal CLK3 is supplied to the control input terminal 1130. When the third clock signal CLK3 is supplied to the control input terminal 1130, the second first transistor M1" is turned on. When the second first transistor M1" is turned on, the third clock signal CLK3 is supplied to the gate electrode of the second third transistor M3" so that the second third transistor M3" is turned on. When the second third transistor M3" is turned on, the third clock signal CLK3 is supplied to the second node N2.

In a $32^{nd}$ period T32, the (i−4)th carry signal CRi−4 is supplied to the third input terminal 1123 so that the tenth transistor M10 and the $12^{th}$ transistor M12 are turned on. When the $12^{th}$ transistor M12 is turned on, the voltage of the second power source VSS2 is supplied to the second node N2. Then, the second power source VSS2 caused by the $12^{th}$ transistor M12 is supplied to the second node N2 and the third clock signal CLK3 caused by the second third transistor M3" is supplied to the second node N2. At this time, W/L of the $12^{th}$ transistor M12 may be set to be larger than that of the second third transistor M3" so that the voltage of the second node N2 is reduced to the voltage of the second power source VSS2.

When the $10^{th}$ transistor M10 is turned on, the (i−4)th carry signal CRi−4 is supplied to the first node N1. When the (i−4)th carry signal CRi−4 is supplied to the first node N1, the fifth transistor M5 and the seventh transistor M7 are turned on. At this time, a voltage corresponding to turning on of the seventh transistor M7 is stored in the first capacitor C1 and a voltage corresponding to turning on of the fifth transistor M5 is stored in the second capacitor C2.

In a 33rd period T33, the first clock signal CLK1 is supplied to the first input terminal 1121. At this time, since the fifth transistor M5 and the seventh transistor M7 are set in turn on states, the first clock signal CLK1 supplied to the first input terminal 1121 is supplied to the first output terminal 1126 and the second output terminal 1127. Here, the first clock signal CLK1 supplied to the first output terminal 1126 is supplied to previous and next stages as the carry signal CRi. The first clock signal CLK1 supplied to the second output terminal 1127 is supplied to the scan line Si as the scan signal SSi.

When the first clock signal CLK1 is supplied to the first output terminal 1126, the second transistor M2 and the fourth transistor M4 are turned on. When the second transistor M2 is turned on, the first power source VSS1 is supplied to the gate electrode of the third transistor M3. When the fourth transistor M4 is turned on, the voltage of the first power source VSS1 is supplied to the second node N2. Then, although the 12th transistor M12 is turned off in the 33rd period T33, the second node N2 maintains a gate off voltage.

In addition, when the first clock signal CLK1 is supplied to the first output terminal 1126 and the second output terminal 1127, the voltage of the first node N1 is increased by the first capacitor C1 and the second capacitor C2 so that the fifth transistor M5 and the seventh transistor M7 stably maintain turn on states.

In a 34th period T34, the (i+4)th carry signal CRi+4 is supplied to the fourth input terminal 1124. When the (i+4)th carry signal CRi+4 is supplied to the fourth input terminal 1124, the 13th transistor M13, the 14th transistor M14, and the 16th transistor M16 are turned on. When the 16th transistor M16 is turned on, the voltage of the first power source VSS1 is supplied to the second output terminal 1127. When the 14th transistor M14 is turned on, the first node N1 is connected to the second power source VSS2 via the 14th transistor M14 and the 15th transistor M15 so that the voltage of the first node N1 is reduced approximately to the voltage of the second power source VSS2.

When the 13th transistor M13 is turned on, the voltage of the second power source VSS2 is supplied to the gate electrodes of the second transistor M2 and the fourth transistor M4, the gate electrodes of the second second transistor M2" and the second fourth transistor M4", and the first output terminal 1126. Then, the second transistor M2 and the fourth transistor M4 and the second second transistor M2" and the second fourth transistor M4" are turned off and the first output terminal 1126 is initialized to the voltage of the second power source VSS2.

In the 34th period T34, the second first transistor M1" and the second third transistor M3" are turned on in response to the third clock signal CLK3 so that the voltage of the second node N2 is increased to the voltage of the third clock signal CLK3.

In a 35th period T35, the seventh clock signal CLK7 is supplied to the second input terminal 1122 so that the first transistor M1 and the third transistor M3 are turned on. When the third transistor M3 is turned on, the second node N2 receives the voltage of the seventh clock signal CLK7.

In a 36th period T36, the (i+8)th carry signal CRi+8 is supplied to the fifth input terminal 1125. When the (i+8)th carry signal CRi+8 is supplied to the fifth input terminal 1125, the ninth transistor M9 is turned on. When the ninth transistor M9 is turned on, the voltage of the second power source VSS2 is supplied to the first node N1.

Figure 16:
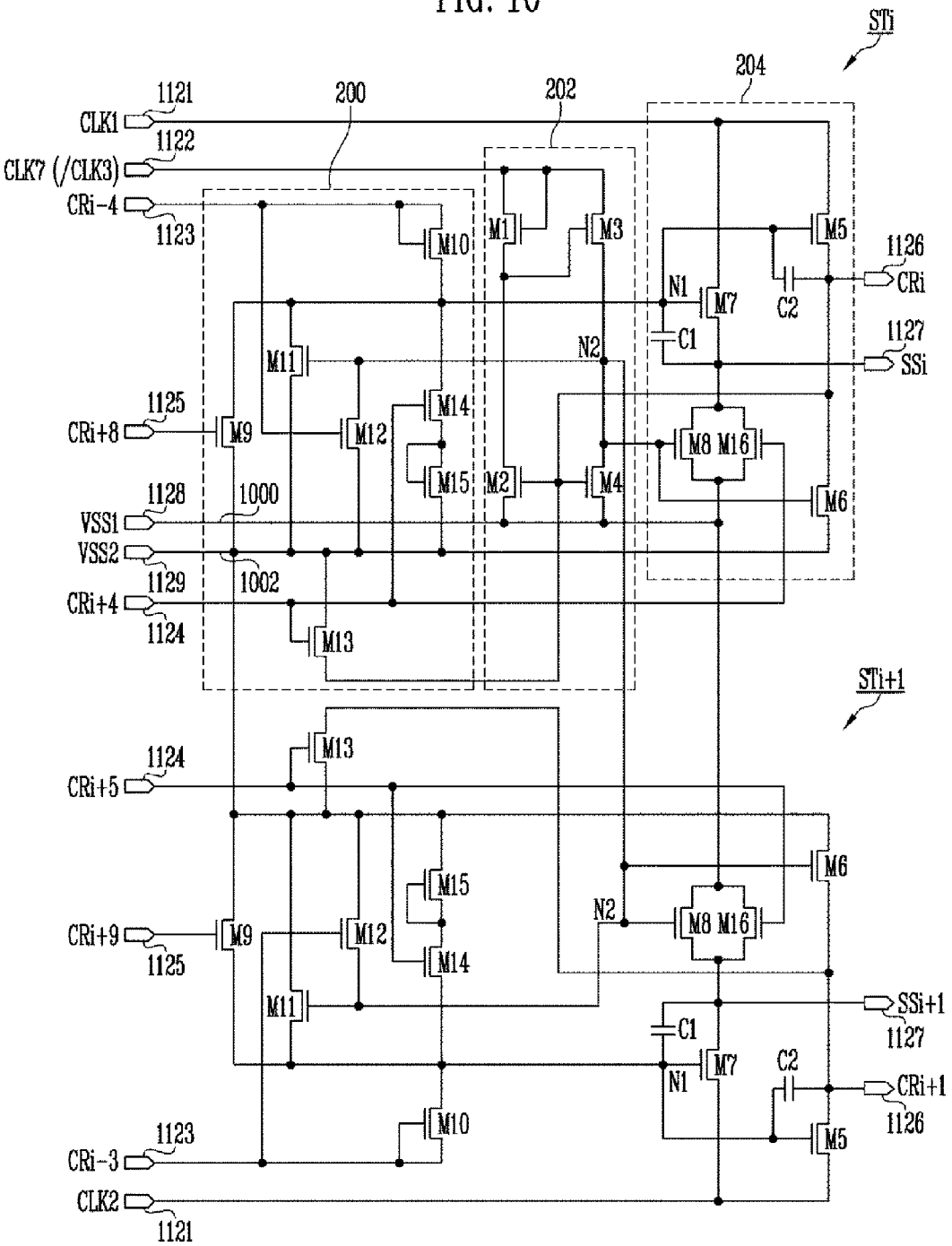
FIG. 16 is a view illustrating connection processes of stages according to an embodiment of the present inventive concept.

FIG. 16 is a view illustrating connection processes of stages according to an embodiment of the present inventive concept.

Referring to FIG. 16, according to the embodiment of the present inventive concept, neighboring stages STi and STi+1 are connected to the first power source input terminal 1128 and a first power source line 1000 for supplying the first power source VSS1 and the second power source input terminal 1129 and are symmetrically formed based on a second power source line 1002 for supplying the second power source VSS2.

The (i+1)th stage STi+1 shares the controller 202 of the ith stage STi. That is, the ith stage STi includes the controller 202 and the (i+1)th stage STi+1 does not include a controller and is connected to the controller 202 of the ith stage STi to be driven. For this purpose, the second node N2 of the ith stage STi and the second node N2 of the (i+1)th stage STi+1 are electrically connected.

When the first clock signal CLK1 is supplied to the first input terminal 1121 of the ith stage STi, the second clock signal CLK2 is supplied to the first input terminal 1121 of the (i+1)th stage STi+1. A clock signal, for example, the seventh clock signal CLK7 that maintains a gate on voltage when voltages of the first clock signal CLK1 and the second clock signal CLK2 are rising from the gate off voltage to the gate on voltage is supplied to the second input terminal 1122 connected to the controller 202.

In the above-described embodiments of FIG. 16, the neighboring stages STi and STi+1 share the controller 202 so that it is possible to reduce a size and manufacturing cost of a circuit. Since operation processes of the stages STi and STi+1 are the same as described in the embodiments of the present inventive concept, description thereof will not be given.

Figure 17:
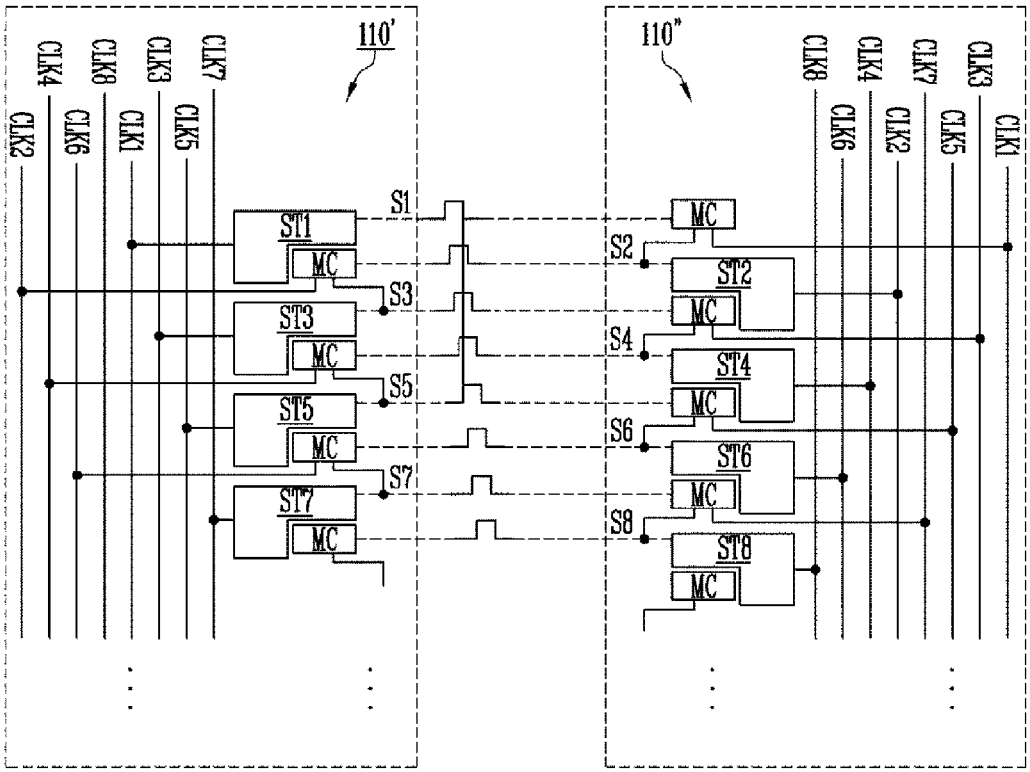
FIG. 17 is a view illustrating scan drivers according to another embodiment of the present inventive concept.

FIG. 17 is a view illustrating scan drivers according to another embodiment of the present inventive concept.

Referring to FIG. 17, scan drivers 110' and 110" according to another embodiment of the present inventive concept are formed on one side and the other side of a liquid crystal panel to face each other.

The first scan driver 110' formed on one side of the liquid crystal panel supplies scan signals to odd scan lines S1, S3, . . . . For this purpose, the first scan driver 110' includes stages ST1, ST3, . . . that are respectively connected to the odd scan lines S1, S3 . . . .

The second scan driver 110" formed on the other side of the liquid crystal panel supplies scan signals to even scan lines S2, S4, . . . . For this purpose, the second scan driver 110" includes stages ST2, ST4, . . . that are respectively connected to the odd scan lines S2, S4 . . . . Here, the stages ST1, ST2, ST3, . . . may be implemented by one of the circuits according to the above-described embodiments of the present inventive concept.

On the other hand, the scan drivers 110' and 110" according to another embodiment of the present inventive concept include control transistors MC that are respectively connected to the scan lines S1 to Sn.

The control transistors MC connected to the odd scan lines S1, S3, . . . are formed on the other side of the liquid crystal panel and the control transistors MC connected to the even scan lines S21, S43, . . . are formed on one side of the liquid crystal panel.

Figure 18:
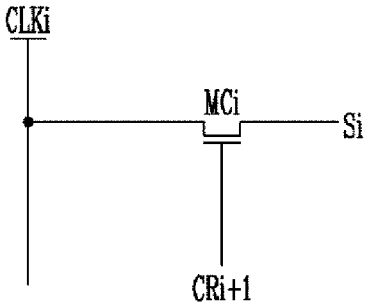
FIG. 18 is a view illustrating an embodiment of the control transistor of FIG. 17.

As illustrated in FIG. 18, a first electrode of the ith control transistor MCi is connected to the ith scan line Si. A clock signal supplied to the ith scan line Si, that is, a clock signal (for example, an ith clock signal) supplied to the ith scan line Si as a scan signal is supplied to a second electrode of the ith control transistor MCi. In addition, an (i+1)th carry signal CRi+1 is supplied to a gate electrode of the ith control transistor MCi.

The ith control transistor MCi is turned on when the (i+1)th carry signal CRi+1 is supplied and supplies an ith clock signal to the ith scan line Si. Then, the ith clock signal is supplied to the ith scan line Si from the one side and the other side of the liquid crystal panel so that the scan signal may be stably received without voltage drop.

By way of summation and review, in general, a display device includes a data driver for supplying data signals to data lines, a scan driver for supplying scan signals to scan lines, and a pixel unit including pixels positioned in regions divided by the scan lines and the data lines.

The pixels included in the pixel unit are selected when the scan signals are supplied to the scan lines and receive the data signals from the data lines. The pixels that receive the data signals supply light components with brightness components corresponding to the data signals to the outside.

The scan driver includes stages connected to the scan lines. The stages supply the scan signals to the scan lines connected thereto in response to signals from a timing controller. For this purpose, the stages are formed of p-type (for example, p-channel metal-oxide semiconductor field effect (PMOS)) transistors and/or n-type (for example, n-channel metal-oxide semiconductor field effect (NMOS)) transistors and may be simultaneously mounted on a panel with the pixels.

On the other hand, as the panel is enlarged, loads of the scan lines increase so that desired scan signals may not be supplied. Therefore, a scan driver capable of being applied to a large panel and stably supplying scan signals is required.

In the scan driver according to the embodiment of the present inventive concept, one of a plurality of clock signals is supplied to a scan line as a scan signal so that loads of the clock signals are minimized so that the scan signals may be stably supplied in the large panel.

In addition, in the scan driver according to the embodiment of the present inventive concept, before a clock signal is supplied to a first electrode of a pull-up transistor, a gate off voltage is supplied to a second electrode of the pull-up transistor so that stability of an operation may be secured. That is, according to the present inventive concept, after a voltage of a second node connected to a pull-down transistor is set as a gate off voltage, since the clock signal is supplied to the first electrode of the pull-up transistor, it is possible to prevent driving stability from deteriorating due to a voltage ripple.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present inventive concept as set forth in the following claims.

What is claimed is:

1. A scan driver comprising sequential stages respectively connected to scan lines to output one of a plurality of clock signals as a scan signal, the sequential stages being numbered by an ith stage circuit numbering system which includes sequential stages of an (i−n)th stage, . . . , an ith stage, . . . , an (i+n)th stage, wherein an ith (i is a natural number) stage circuit among the stages comprises:

an output unit configured to supply an ith carry signal to a first output terminal and supply an ith scan signal to a second output terminal by using a jth (j is a natural number) clock signal supplied to a first input terminal in response to voltages of a first node and a second node, the output unit including a pull-up transistor connected between the first input terminal and the second output terminal, a gate of the pull-up transistor being connected to the first node;

a controller configured to control the voltage of the second node in response to a kth (k is a natural number) clock signal supplied to a second input terminal; and an input unit configured to control the voltages of the first node and the second node in response to a carry signal of a previous stage that is supplied to a third input terminal and a carry signal of at least one subsequent stage, the input unit including a pull-down transistor directly connected between the first node and a power source input terminal, a gate of the pull-down transistor being directly connected to the second node, and wherein the kth clock signal maintains a gate on voltage when a voltage of the jth clock signal is rising from a gate off voltage to a gate on voltage.

2. The scan driver of claim 1, wherein the power source input terminal includes a first power source input terminal and a second power source input terminal, and wherein the ith stage receives a first power source set to have a gate off voltage from the first power source input terminal and receives a second power source set to have a gate off voltage and having a different voltage from that of the first power source from the second power source input terminal.

3. The scan driver of claim 2, wherein the controller comprises:

a first transistor having a first electrode and a gate electrode connected to the second input terminal;

a second transistor connected between a second electrode of the first transistor and the first power source input terminal and having a gate electrode connected to the first output terminal;

a third transistor connected between the second input terminal and the second node and having a gate electrode connected to the second electrode of the first transistor; and a fourth transistor connected between the second node and the first power source input terminal and having a gate electrode connected to the first output terminal.

4. The scan driver of claim 3, wherein the controller further comprises:

a second first transistor having a first electrode and a gate electrode connected to a control input terminal;

a second second transistor connected between a second electrode of the second first transistor and the first power source input terminal and having a gate electrode connected to the first output terminal;

a second third transistor connected between the control input terminal and the second node and having a gate electrode connected to the second electrode of the second first transistor; and a second fourth transistor connected between the second node and the first power source input terminal and having a gate electrode connected to the first output terminal.

5. The scan driver of claim 4, wherein the control input terminal receives a clock signal having an inverted clock signal of the kth clock signal.

6. The scan driver of claim 2, wherein the controller comprises:

a first transistor having a first electrode and a gate electrode connected to the second input terminal;

a second transistor connected between a second electrode of the first transistor and the first power source input terminal and having a gate electrode connected to the first node;

a third transistor connected between the second input terminal and the second node and having a gate electrode connected to the second electrode of the first transistor; and a fourth transistor connected between the second node and the first power source input terminal and having a gate electrode connected to the first node.

7. The scan driver of claim 2, wherein the output unit comprises:

a fifth transistor connected between the first input terminal and the first output terminal and having a gate electrode connected to the first node;

a sixth transistor connected between the first output terminal and the second power source input terminal and having a gate electrode connected to the second node;

the pull-up transistor;

an eighth transistor connected between the second output terminal and the first power source input terminal and having a gate electrode connected to the second node;

a first capacitor connected between the first node and the second output terminal; and a second capacitor connected between the first node and the first output terminal.

8. The scan driver of claim 7, wherein the output unit further comprises a $16^{th}$ transistor connected between the second output terminal and the first power source input terminal and turned on when a carry signal of a subsequent stage is supplied.

9. The scan driver of claim 8, wherein the carry signal of the subsequent stage is an (i+4)th carry signal.

10. The scan driver of claim 2, wherein the input unit comprises:

a ninth transistor connected between the first node and the second power source input terminal and turned on when a first carry signal of a subsequent stage is supplied;

a tenth transistor having a first electrode and a gate electrode connected to the third input terminal and having a second electrode connected to the first node;

the pull-down transistor;

a $12^{th}$ transistor connected between the second node and the second power source input terminal and having a gate electrode connected to the third input terminal; and a $13^{th}$ transistor connected between the second power source input terminal and the first output terminal and turned on when a second carry signal of a subsequent stage is supplied.

11. The scan driver of claim 10, wherein an (i−4)th carry signal is supplied to the third input terminal, the (i−4)th carry signal being a carry signal outputting from an (i−4)th stage.

12. The scan driver of claim 10, wherein the first carry signal is an (i+6)th carry signal and the second carry signal is an (i+4)th carry signal.

13. The scan driver of claim 10, wherein the first carry signal and the second carry signal are (i+6)th carry signals, the (i+6)th carry signal being a carry signal outputting from an (i+6)th stage.

14. The scan driver of claim 10, wherein the input unit further comprises:

a $14^{th}$ transistor connected between the first node and the second power source input terminal and turned on when the second carry signal is input; and a $15^{th}$ transistor having a first electrode and a gate electrode connected to the second electrode of the $14^{th}$ transistor and having a second electrode connected to the second power source input terminal.

15. The scan driver of claim 14, wherein the first carry signal is an (i+8)th carry signal and the second carry signal is an (i+6)th carry signal.

16. The scan driver of claim 2, wherein the (i+1)th stage shares a controller of the ith stage.

17. The scan driver of claim 16, wherein a second node of the (i+1)th stage is electrically connected to a second node of the ith stage.

18. The scan driver of claim 16, wherein a (j+1)th clock signal of which gate on voltage period overlaps the jth clock signal is supplied to the second node of the (i+1)th stage, and wherein the kth clock signal maintains a gate on voltage when voltages of the jth clock signal and the (j+1)th clock signal are rising from gate off voltages to gate on voltages.

19. The scan driver of claim 16, wherein the ith stage is formed on one side of a panel and supplies a scan signal to an ith scan line, and wherein the scan driver further comprises a control transistor connected to the other side of the ith scan line to supply the jth clock signal to the ith scan line when an (i+1)th carry signal is supplied.

20. The scan driver of claim 1, wherein the clock signals are sequentially supplied to maintain gate on voltages in 4 horizontal periods and to maintain gate off voltages in 4 horizontal periods, and wherein a previously supplied clock signal and a currently supply clock signal have a phase difference of a 1 horizontal period.

* * * * *